US008607925B2

(12) United States Patent
Gideonse

(10) Patent No.: US 8,607,925 B2
(45) Date of Patent: Dec. 17, 2013

(54) WEDGE-SHAPED ACOUSTIC DIFFUSER AND METHOD OF INSTALLATION

(76) Inventor: Hendrik David Gideonse, Medford, MA (US)

( * ) Notice: Subject to any disclaimer, the term of this patent is extended or adjusted under 35 U.S.C. 154(b) by 129 days.

(21) Appl. No.: 13/184,604

(22) Filed: Jul. 18, 2011

(65) Prior Publication Data

US 2012/0018247 A1 Jan. 26, 2012

Related U.S. Application Data

(60) Provisional application No. 61/365,864, filed on Jul. 20, 2010.

(51) Int. Cl.

| | |
|---|---|
| ***E04B 1/84*** | (2006.01) |
| ***E04B 1/99*** | (2006.01) |
| ***G10K 11/172*** | (2006.01) |
| *E04B 1/82* | (2006.01) |
| *G10K 11/16* | (2006.01) |

(52) U.S. Cl.
USPC ..... 181/293; 181/210; 181/30

(58) Field of Classification Search
USPC ..... 181/293, 295, 284, 285, 210, 30
See application file for complete search history.

(56) References Cited

U.S. PATENT DOCUMENTS

| | | | | | |
|---|---|---|---|---|---|
| 1,554,180 | A | * | 9/1925 | Trader | 52/144 |
| 1,875,074 | A | * | 8/1932 | Mason | 181/293 |
| 2,459,121 | A | * | 1/1949 | Willey et al. | 181/293 |
| 2,652,126 | A | * | 9/1953 | Mazer | 181/293 |
| 2,779,429 | A | * | 1/1957 | Mazer et al. | 181/293 |
| 2,935,152 | A | * | 5/1960 | Maccaferri | 181/290 |
| 3,382,947 | A | * | 5/1968 | Biggs | 181/30 |
| 3,712,413 | A | * | 1/1973 | Eckel | 181/295 |
| 3,734,234 | A | * | 5/1973 | Wirt | 181/286 |
| 3,857,459 | A | * | 12/1974 | Adams et al. | 181/295 |
| 3,913,702 | A | * | 10/1975 | Wirt et al. | 181/286 |
| 4,094,379 | A | * | 6/1978 | Steinberger | 181/284 |
| 4,141,433 | A | * | 2/1979 | Warnaka | 181/286 |
| 4,265,955 | A | * | 5/1981 | Harp et al. | 428/116 |
| 4,296,831 | A | * | 10/1981 | Bennett | 181/224 |
| 4,327,816 | A | * | 5/1982 | Bennett | 181/292 |
| 4,339,018 | A | * | 7/1982 | Warnaka | 181/286 |

(Continued)

OTHER PUBLICATIONS

Gideonse, Hendrik, "The Acoustic Ramp: An Analysis of Diffuser Testing Methodologies," Master's Thesis, May 2012, University of Massachusetts Lowell. USA.

(Continued)

*Primary Examiner* — Edgardo San Martin
(74) *Attorney, Agent, or Firm* — Barret Lippey

(57) ABSTRACT

A wedge-shaped, number theoretical acoustic diffuser both diffuses and reflects sound while eliminating wasted space created by prior art. The inventive diffuser consists of wells of continuously variable depths which provide wide-bandwidth diffusion in a single dimension. The back of the wells are reflective planes of a plurality of angles that direct energy away from the sound source. The invention may be installed in the upper corners of a room, with the deepest end of the wedge-shape up and tapering down to the thinnest end of the wedge shape. This installation allows floor standing furniture or other objects to be placed against the wall, an impossibility with the installation of prior art. The present invention may be installed as an array in which the deepest ends of the wedge shape are butted together. This formation splits and reflects sound in two different directions both away from the sound source.

6 Claims, 34 Drawing Sheets

(56) References Cited

U.S. PATENT DOCUMENTS

| | | | | | |
|---|---|---|---|---|---|
| 4,362,222 | A | * | 12/1982 | Hellstrom | 181/30 |
| 4,681,481 | A | * | 7/1987 | Kapusta | 404/34 |
| D291,601 | S | * | 8/1987 | D'Antonio et al. | D25/160 |
| 4,821,839 | A | * | 4/1989 | D'Antonio et al. | 181/198 |
| 4,925,338 | A | * | 5/1990 | Kapusta | 404/41 |
| 5,141,073 | A | * | 8/1992 | Pelonis | 181/30 |
| 5,160,816 | A | * | 11/1992 | Chlop | 181/285 |
| 5,250,764 | A | * | 10/1993 | Doychak et al. | 181/224 |
| 5,401,921 | A | * | 3/1995 | D'Antonio et al. | 181/286 |
| 5,579,614 | A | * | 12/1996 | Dorn | 52/144 |
| 5,623,130 | A | * | 4/1997 | Noxon | 181/30 |
| 5,700,983 | A | * | 12/1997 | VonDross | 181/285 |
| 5,764,782 | A | * | 6/1998 | Hayes | 381/160 |
| 5,780,785 | A | * | 7/1998 | Eckel | 181/295 |
| 5,959,264 | A | * | 9/1999 | Bruck et al. | 181/286 |
| 5,969,301 | A | * | 10/1999 | Cullum et al. | 181/286 |
| 5,992,561 | A | * | 11/1999 | Holben et al. | 181/295 |
| 6,015,026 | A | * | 1/2000 | McGrath | 181/295 |
| 6,209,680 | B1 | * | 4/2001 | Perdue | 181/295 |
| 6,244,378 | B1 | * | 6/2001 | McGrath | 181/292 |
| 6,772,859 | B2 | * | 8/2004 | D'Antonio et al. | 181/293 |
| 6,782,670 | B2 | * | 8/2004 | Wendt | 52/506.07 |
| 7,322,441 | B2 | * | 1/2008 | D'Antonio et al. | 181/293 |
| 7,428,948 | B2 | * | 9/2008 | D'Antonio et al. | 181/293 |
| 7,520,370 | B2 | * | 4/2009 | Gudim | 181/293 |
| 7,565,951 | B1 | * | 7/2009 | Perdue | 181/287 |
| 7,604,094 | B2 | * | 10/2009 | Magyari | 181/286 |
| 7,703,575 | B2 | * | 4/2010 | Berger et al. | 181/293 |
| 7,721,847 | B2 | * | 5/2010 | Coury | 181/293 |
| 2007/0034448 | A1 | * | 2/2007 | D'Antonio et al. | 181/293 |

OTHER PUBLICATIONS

Cox, Trevor J., and D'Antonio, Peter, "Chapter 4: Measurement and characterization of diffuse reflections or scattering," 2009, pp. 110-155, "Acoustic Absorbers and Diffusers: Theory, Design and Application, 2nd ed," Taylor & Francis, London, UK.

Cox, Trevor J., and D'Antonio, Peter, "Chapter 9: Schroeder Diffusers," 2009, pp. 289-330, "Acoustic Absorbers and Diffusers: Theory, Design and Application, 2nd ed," Taylor & Francis, London, UK.

Cox, Trevor J., and D'Antonio, Peter, "Chapter 10: Geometric Reflectors and Diffusers," 2009, pp. 331-372, "Acoustic Absorbers and Diffusers: Theory, Design and Application, 2nd ed," Taylor & Francis, London, UK.

Everest, F. A. , "Chapter 13: Diffusion of Sound," 2001, pp. 267-288, "Master Handbook of Acoustics, 4th ed.," McGraw-Hill, New York, USA.

Everest, F. A. , "Chapter 14: The Schroeder Diffuser," 2001, pp. 289-316, "Master Handbook of Acoustics, 4th ed.," McGraw-Hill, New York, USA.

Schroeder, Manfred R., "Binaural Dissimilarity and Optimum Ceilings for Concert Halls: More Lateral Sound Diffusion," Journal of Acoustical Society of America, 1979, vol. 65, No. 4, pp. 958-963, Acoustical Society of America, Melville, NY.

Schroeder, Manfred R., "Progress in Architectural Acoustics and Artificial Reverberation: Concert Hall Acoustics and Number Theory." Journal of the Audio Engineering Society, Apr. 1984, vol. 32, No. 4, pp. 194-203, Audio Engineering Society, NY.

Schroeder, Manfred R., "Diffuser Sound Reflection by Maximum-Length Sequences." Journal of Acoustical Society of America, Jan. 1975, vol. 57, No. 1, pp. 149-150, Acoustical Society of America, Melville, NY.

Walker, R., "The Design and Application of Modular Diffusing Elements," BBC Research Department, 1990, Report No. 15, pp. 1-14, BBC, London.

Cox, Trevor J., and D'Antonio, Peter, "Optimized Planar and Curved Diffsorbers," Audio Engineering Society Preprint, 107th Convention Sep. 1999, Audio Engineering Society, New York.

* cited by examiner

WEDGE-SHAPED ACOUSTIC DIFFUSER AND METHOD OF INSTALLATION

CROSS REFERENCE TO RELATED APPLICATIONS

This application claims the benefit of Provisional Patent Application Ser. No. 61/365,864 filed on Jul. 20, 2010 by the present inventor.

BACKGROUND OF THE INVENTION

In the field of Acoustics, there exist only four commonly-accepted means of changing acoustic phenomenon: absorption, reflection, refraction, and diffusion. Absorption is the process in which acoustic energy comes in contact with a material that converts the energy into heat. Reflection is the process in which acoustic energy strikes a material and is redirected largely unchanged. The angle of incidence of the sound source relative to the reflector is equal to the angle of reflection. In this way, sound behaves very much like a rubber ball striking a hard flat surface. Refraction is the process in which acoustic energy bends around or is blocked by objects.

Diffusion is the process in which acoustic energy comes in contact with a rigid, non-uniform shape with lots of surface area and scatters in many different directions. Diffusion causes a measurable reduction in acoustic energy because the energy is spread over a large surface area. When a sound heads toward a surface that is uneven, non-uniform and with a varied texture the sound does not strike the surfaces all at the same time. The resulting reflections return with small changes in timing or phase. A good diffuser causes both scattering, creating reflections in many directions, and changes in phase, creating reflections at many times. One measure of diffusion involves examining how an impulse of acoustic energy is smeared or spread out over an amount of time.

The classic historical concert halls all possessed many irregular surfaces. Alcoves with sculptures and heavily encrusted and ornamented moldings act as excellent if unintentional diffusers. The problem in modern acoustics is to find better diffusive shapes that are easier to manufacture than hand carved moldings and marble sculpture.

Diffusers are considered to be either one dimensional or two dimensional. Sound striking a single-dimensional or 1D diffuser would be diffused in a semi-circular pattern away from the diffuser in a single horizontal dimension. A two-dimensional or 2D diffuser would diffuse sound in a hemispherical pattern, both horizontally and vertically.

Manfred R. Schroeder is the father of modern acoustic diffusion research. Nearly all diffusers designed and manufactured today are at least partially based on his ground breaking research. He was the first scholar to explore the use of rectilinear wells of different depths as a means of diffusing acoustic energy. Schroeder applied the idea of the light and x-ray scattering property of crystals to the scattering of acoustic energy. The concept of this type of diffusion is called reflection phase grating Schroeder explored the use of both quadratic residue and primitive root number sequences to define the depth of a series of wells in acoustic diffusers. These number sequences have been employed time and again by different diffuser designers. For whatever reason, Manfred Schroeder did not explore either quadratic residue diffusers or primitive root diffusers in a commercial sense. This was largely done by Peter D'Antonio of RPG Diffuser Systems, Inc.

Schroeder's one-dimensional diffusers consist of a series of rectilinear wells each with the same height and width, but with varying depths. The depths of the wells determine the lowest frequency scattered by the diffuser. The width of the wells determine the highest frequency diffused. Manfred Schroeder's work on number theoretical acoustic diffusers gives us the following formulas:

$$\text{Lowest Diffused Frequency (Hz)} \approx \frac{\text{Speed of Sound}}{4*(\text{Depth of Deepest Well})}$$

$$\text{Highest Diffused Frequency (Hz)} \approx \frac{\text{Speed of Sound}}{2*(\text{Width of Wells})}$$

Schroeder explored the use of both quadratic residue and primitive root number sequences to determine the depth of wells in his diffusers.

FIG. A-1 shows an elevation of a Quadratic Residue sequence of depths based on prime number 7. Examples of other Quadratic-Residue Sequences with the prime number from which they are derived:

p=5: 0 1 4 4 1 0
p=7: 0 1 4 2 2 4 1 0
p=11: 0 1 4 9 5 3 3 5 9 4 1 0
p=13: 0 1 4 9 3 12 10 10 12 3 9 4 1 0
p=17: 0 1 4 9 16 8 2 15 13 13 15 2 8 16 9 4 1 0
p=19: 0 1 4 9 16 16 6 17 11 7 5 5 7 11 17 6 16 9 4 1 0
p=23: 0 1 4 9 16 2 13 3 18 12 8 6 6 8 12 18 3 13 2 16 9 4 1 0

Examples of Primitive-Root sequences and the prime number from which they are derived:

p=5: 2 4 3 1
p=7: 3 2 6 4 5 1
p=11: 2 4 8 5 10 9 7 3 6 1
p=13: 2 4 3 3 6 12 10 9 5 10 7 1
p=17: 3 9 10 13 5 15 11 16 14 8 7 4 12 2 6 1
p=19: 2 4 8 16 13 7 14 9 18 17 15 11 3 6 12 5 10 1 (Everest, 2001)

Commercially available as RPG Inc's Quadratic Residue Diffuser or QRD™

Peter D'Antonio et al Pat. No. D291601

Depicted in FIG. 2

Commercially named the QRD™ and called an Acoustic baffle in patent D291,601, this diffuser is essentially an embodiment of Manfred Schroeder's quadratic residue diffuser. A box is divided into a plurality of wells with thin dividers. The depth of these wells is varied based on quadratic residue number sequences. The wells are all rectilinear in shape, with the back of the wells parallel to the face of the diffuser. In the acoustic treatment industry, this design is probably the most copied of all of the other one-dimensional designs.

There are two disadvantages of this design:

First, this is a one-dimensional diffuser and thus diffusion only occurs laterally in a fan shaped pattern in a single dimension. In other words, sound is scattered to the sides but not up and down. If the QRD is installed so that the dividers run horizontally, then diffusion only occurs vertically.

Second, a rectilinear or box-shaped diffuser wastes valuable floor space. In order to diffuse lower frequencies, a QRD diffuser must be as deep front to back as possible. As mentioned in the discussion of Manfred Schroeder's research, the depth of the deepest well is ¼ the wavelength of the lowest affected frequency. For instance, a diffuser with a maximum well depth of 1 foot will diffuse frequencies up to 4 feet in length. Using the formula:

$$\lambda(\text{Wavelength}) \approx \frac{\text{Speed of Sound}}{\text{Frequency}}$$

We find that this lowest frequency is approximately 281.5 Hz.

A typical installation of a diffuser is on the rear wall of a critical listening space. A 1-foot-deep QRD diffuser would extend into the room a minimum of 1 foot trapping an unusable space below the diffuser where furniture or other items cannot be placed. At best, this space can be enclosed and used as cabinet storage or low shelving. Visually, the front of the dividers becomes the new location of the wall.

The Acoustic Ramp's wedge shape avoids both of the above mentioned disadvantages.

First, the Acoustic Ramp diffuses sound energy laterally much the same way that the QRD™ diffuses energy, and it also reflects the energy at several different angles vertically. For instance, in Embodiment 1 of the present invention, there are reflectors at approximately 0, 7, 10.5 and 14 degrees. The present invention is installed vertically with the deeper end in the upper corner made between the ceiling and wall. The Acoustic Ramp with scatter sound in all directions horizontally and reflect the sound down toward the floor and away from the sound source vertically.

Second, the variable depth of the wedge shape allows installation into upper corners, using this often unused space for diffusion. The diffuser tapers to flat as it descends the wall allowing furniture or other objects to be pushed all the way against the wall. This prevents the trapping of floor space exhibited by the QRD™ diffuser.

Burton E. Cullum et al U.S. Pat. No. 5,969,301

Depicted in FIG. 3

Burton Cullum's Acoustic Diffuser Panel System is essentially a two period quadratic residue diffuser based on the prime number 7 or the familiar 0 1 4 2 2 4 1 0 pattern. The biggest advantage of this invention is the possibility of molding the entire structure from a single piece of plastic. This will make the product significantly less expensive to manufacture. The disadvantages however are numerous.

The concave shape of the back of the wells serve to actually focus or amplify rather than diffuse the sound. The early pre-Schroeder attempts at diffusion were actually series of convex shapes in various permutations. The plastic used to mold a diffuser of this nature would need to be very rigid in order to reflect acoustic energy, but thin enough to make manufacturing cost effective.

Similarly to the QRD™ from RPG Inc, this diffuser will only diffuse energy laterally in a single dimension.

Jay Perdue U.S. Pat. No. 6,209,680

Depicted in FIG. 4

Perdue's Acoustic Diffuser Panels have some elements which on the surface might appear similar to the present invention. This diffuser has a modified-wedge shape, but the type of design diminishes the actual diffusive properties. The entire face of the diffuser panel is angled with respect to the back wall of the diffuser. Thus, the face will behave like a reflector, not as a diffuser. The tops and bottom of the wells are angled, but all of the angles in all of the wells are the same. Both of these features will offer very little improvement over 3 flat panels canted at 3 different angles. The wells offer no phase change to reflected sound because the wells are all the same distance away from the sound source. If the back of the diffuser was angled and not the front, this design would likely be significantly more effective.

The angled tops/bottoms of the wells will offer a little phase complexity, but the angle of all the tops/bottoms are the same, minimizing the effect. All of the lower sides of the wells will act as a single reflector, as will all of the upper sides of the wells. Purdue's diffuser could be better viewed as series of small reflectors with three different angles.

Commercially available as RPG Inc's Skyline™ two-dimensional diffuser

Peter D'Antonio et al U.S. Pat. No. 5,401,921

Depicted in FIG. 5

RPG Inc's Skyline™ diffuser is a 2-dimensional diffuser. This means that acoustic energy is diffused in two planes, both vertically and horizontally. It is likely that RPG Inc chose to use a primitive root number sequence because quadratic residue diffusers of the same style were no longer patentable after the BBC's 1990 paper on diffusers (Walker, 1990).

Both the upper and lower frequency limits are defined by the width and height of the square columns respectively. The length of the columns defines the lower frequency boundary, while the upper frequency boundary is defined by the width of the column.

One difficulty with this design lies in appropriate materials for manufacture. The columns must be rigid enough to reflect and not absorb acoustic energy. This means typical foam materials are not appropriate because they tend to absorb certain frequencies. Injection molding or vacuum molding are options, but the cost of the molds and dies to make the forms is quite high. RPG uses expanded polystyrene foam in their commercial models which offers a surface rigid enough to reflect frequencies up to the high frequency limit.

The DIY community commonly builds two dimensional quadratic residue diffusers, based on the BBC paper mentioned above, that are very similar to the Skyline™ diffuser from either wood or foam insulation. The foam insulation absorbs too much sound and the wood version is extremely heavy and hard to install onto walls as a result.

The Skyline diffuser shares the same problem with all of the others diffusers examined in that a deeper diffuser intrudes into the room too much and uses up valuable space. The Acoustic Ramp pushes the deepest part of the diffuser into the upper wall space which is typically unused. This allows diffusion to happen at lower frequencies without using up valuable floor space.

Commercially Available as Art Diffusors by Acoustics First

Bernard W. Chlop U.S. Pat. No. 5,160,816

Depicted in FIG. 6

Chlop's Two-Dimensional Diffuser is not as effective as RPG Inc's Two Dimensional Diffuser because the diffusion is not equal in both the horizontal and vertical plane. While this design also employs the use of square columns at different lengths protruding from a flat base, it does not use a randomizing number sequence to place the columns. Instead the design employs repeating patterns of columns of different heights. This repeated pattern will cause the diffuser to be much less two-dimensional than a near-random orientation of columns generated with a maximum length sequence of numbers.

One of the positive improvements of this design over prior art is the angled reflective ends of the square columns which likely reflects energy away from the sound source. Unfortunately, the rows of columns all have the same angle aligned in the same direction which minimizes this positive effect.

BRIEF SUMMARY OF THE INVENTION

The present invention, herein called the Acoustic Ramp, is a diffuser-type acoustic treatment device that is used to positively change the existing acoustics of a space by scattering reflected acoustic energy in many different directions. The device is essentially a so-called Schroeder Number Theoretical Diffuser that has well depths that are continuously variable due to its wedge shape. The variable depths cause the widening of the effective bandwidth of the diffuser. The angles created by the variable depth reflectors de-parallel the wall on which the device is installed, thus reflecting acoustic energy away from the sound source. The wedge shape of the invention also allows the upper corners of a room to be used for diffusion. The Acoustic Ramp, tapers to a thin profile as the device comes down the wall allowing floor standing furniture or other objects to be placed against the wall. This feature prevents floor space from being trapped and rendered unusable by a rectilinear diffuser.

(1) indicates the 'top edge' of the embodiment.

(2) indicates the two 'front edges' of the embodiment.

(3) indicates the "bottom edge" of the embodiment.

(4) indicates the 'reflectors' of the embodiment.

(5) indicates the 'back plate' of the embodiment, which in a standard installation would be pressed flush to a vertical wall.

Figure 8:
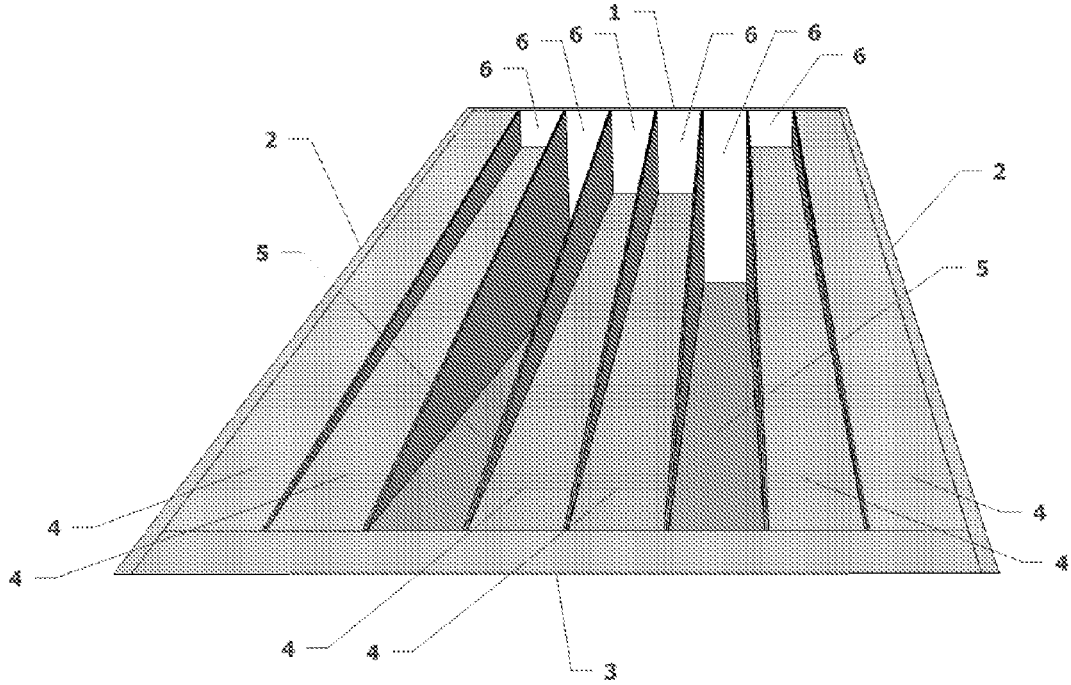

FIG. 8 shows an oblique isometric view of Embodiment 1 of the present invention from the bottom.

(5) indicates the 'back plate' of the embodiment.

(6) indicates the 'top plate' of the embodiment.

Figure 9:
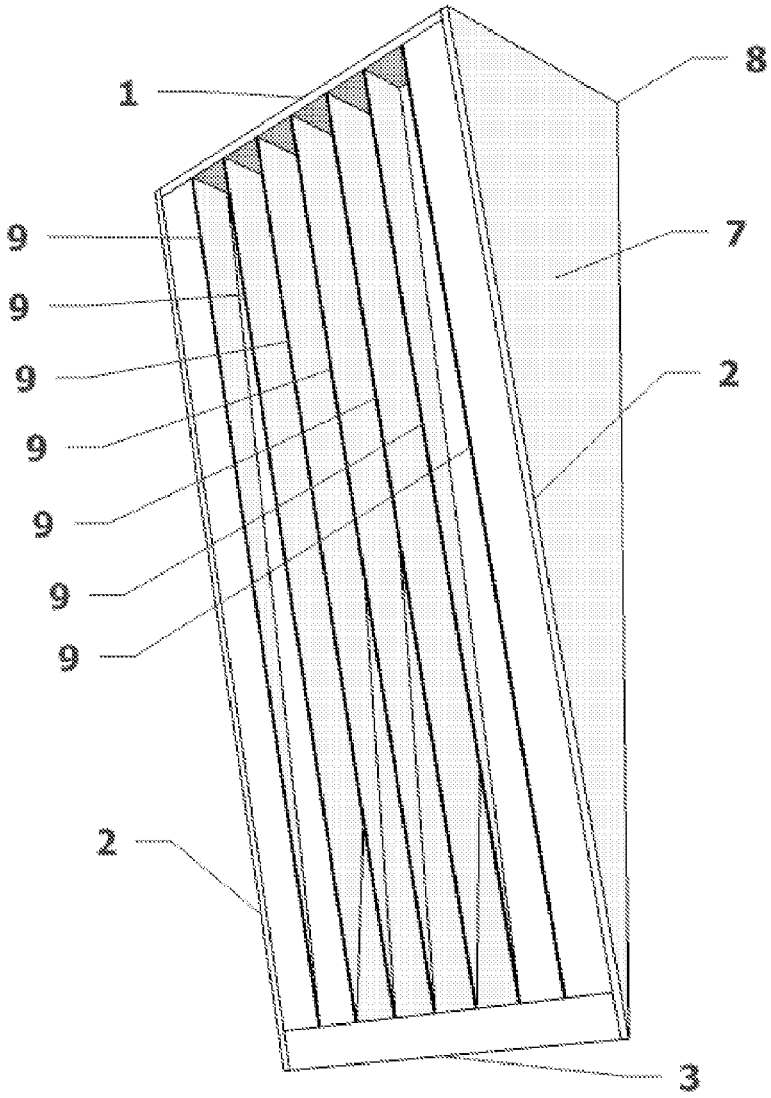

FIG. 9 shows an isometric view of Embodiment 1 of the present invention indicating the following features:

(7) indicates one of two of the 'side panel' pieces of this embodiment of the present invention.

(8) indicates the 'top corner' of this embodiment of the present invention.

(9) indicates the 'well-dividers' which separate all of the 'wells' (10) in this embodiment of the present invention.

Figure 10:
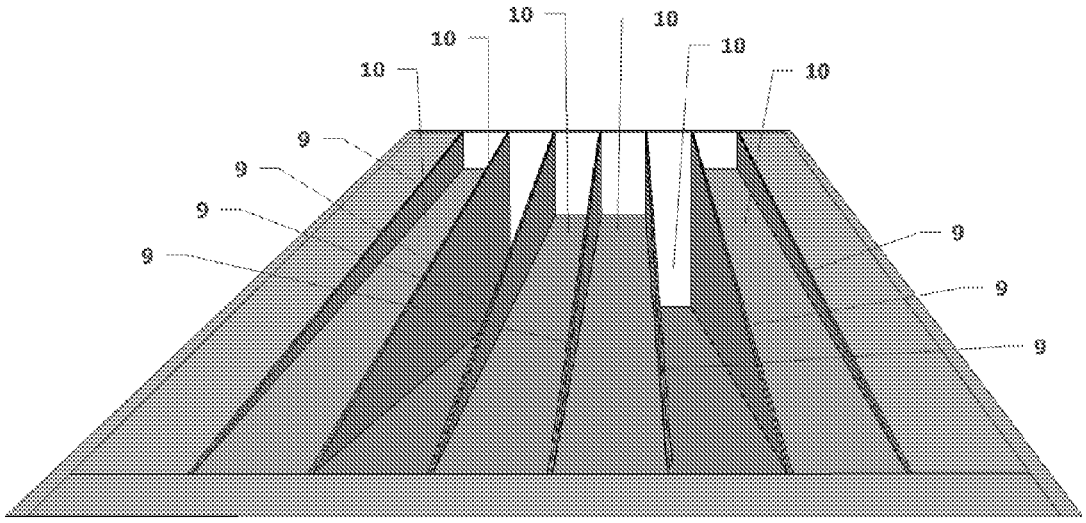

FIG. 10 shows an oblique isometric view of Embodiment 1 of the present invention and indicates the following features:

(9) indicates the 'well-dividers' similarly illustrated in FIG. 9.

(10) indicates the 'wells' of the current embodiment of the present invention.

Figure 11:
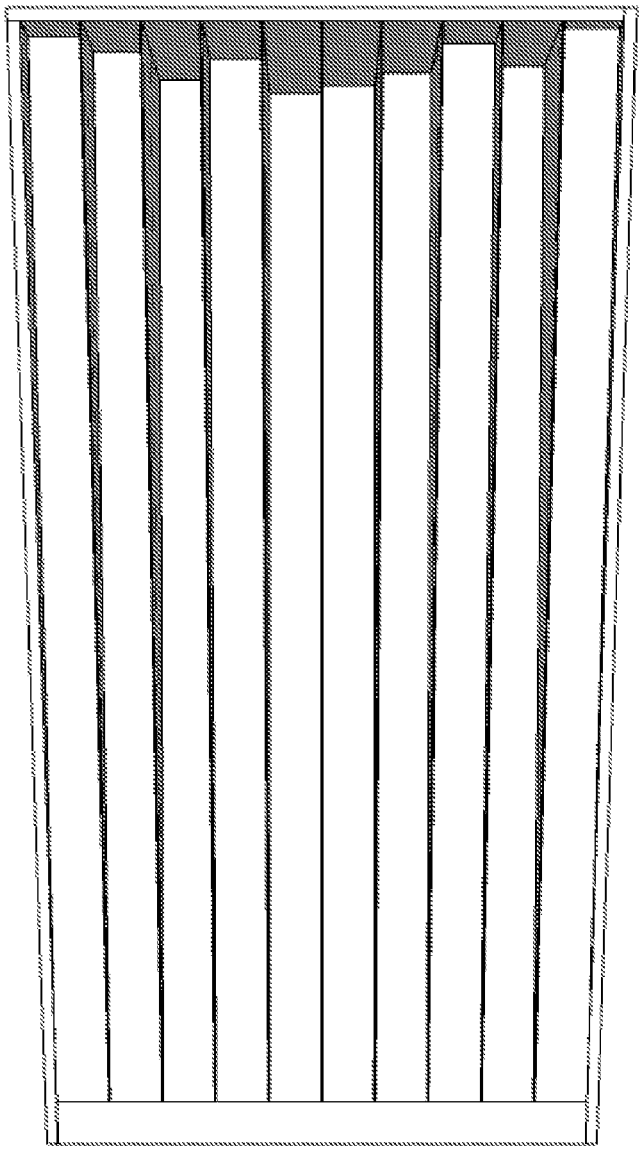

FIG. 11 shows an oblique isometric view of Embodiment 2 of the present invention. This embodiment has a ratio of height:width:depth of 4:2:1. Embodiment 2 uses the following primitive-root sequence for determining proportional depths: 2, 4, 8, 5, 10, 9, 7, 3, 6, 1.

Figure 12:
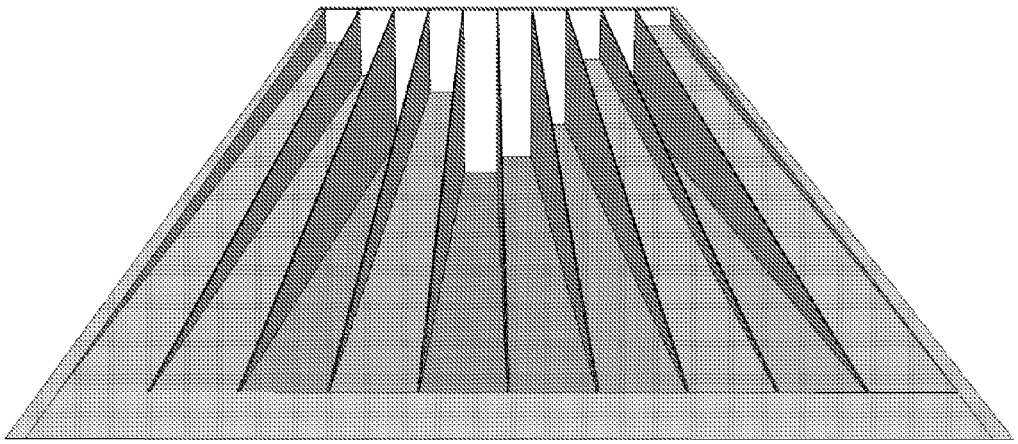

FIG. 12 shows a front oblique isometric of Embodiment 2 of the present invention.

Figure 13:
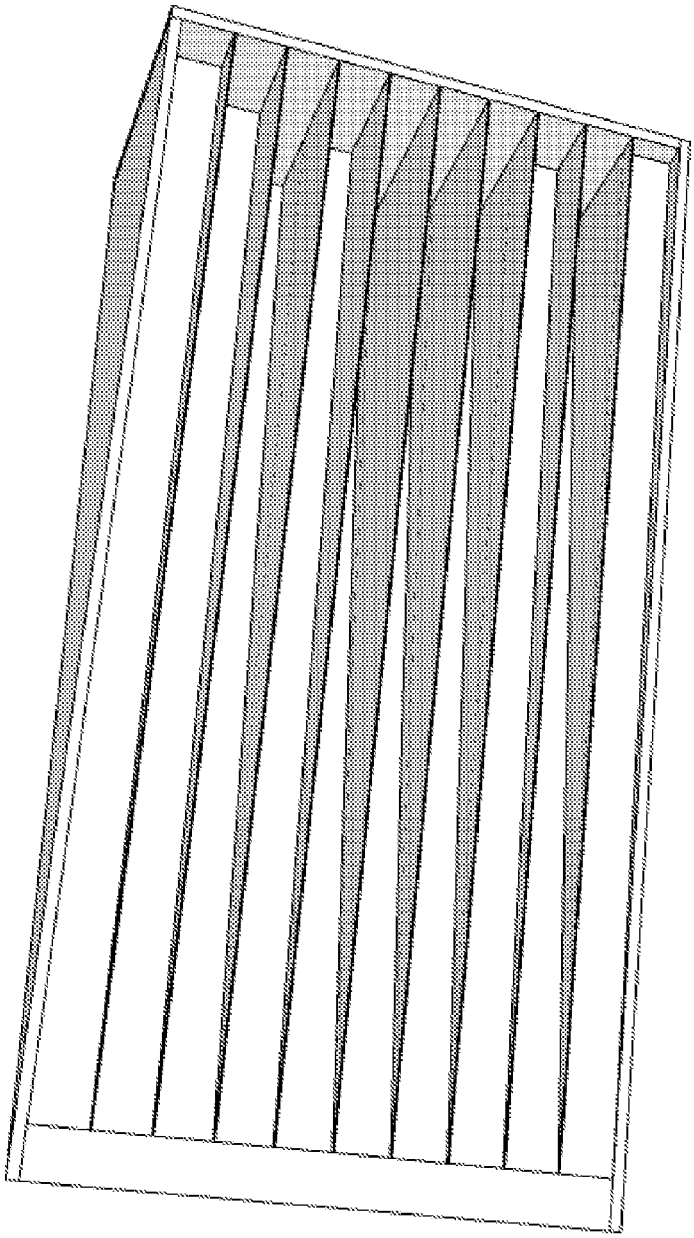

FIG. 13 shows an isometric view of Embodiment 2 of the present invention.

Figure 14:
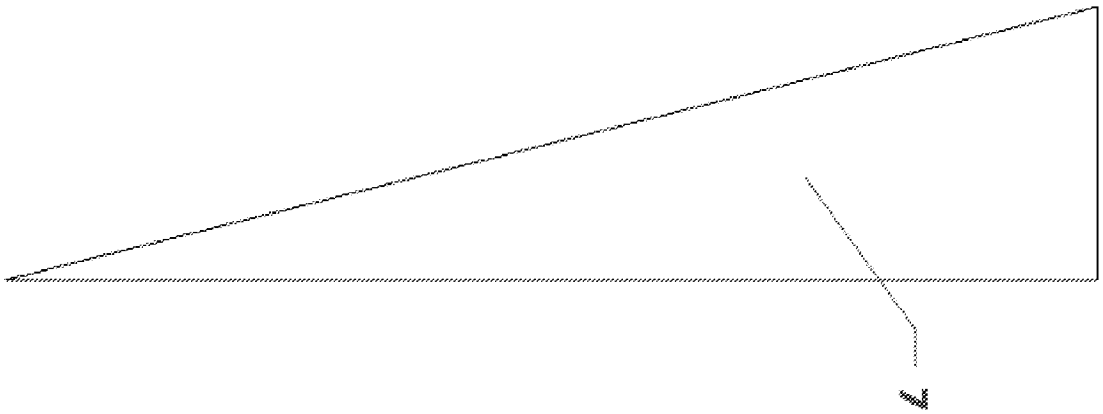

FIG. 14 shows the right 'side panel' (7) of both Embodiment 1 and Embodiment 2 of the present invention. The left side panel is the mirror image of the right side panel.

Figure 15:
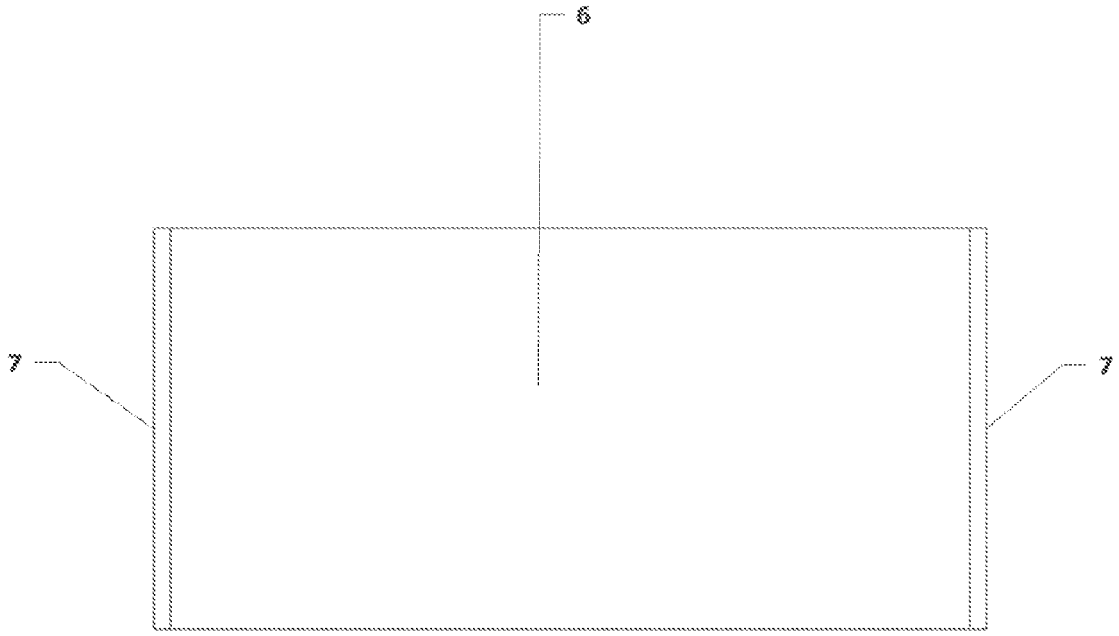

FIG. 15 shows the 'top plate' (6) of both Embodiment 1 and Embodiment 2 of the present invention.

Figure 16:
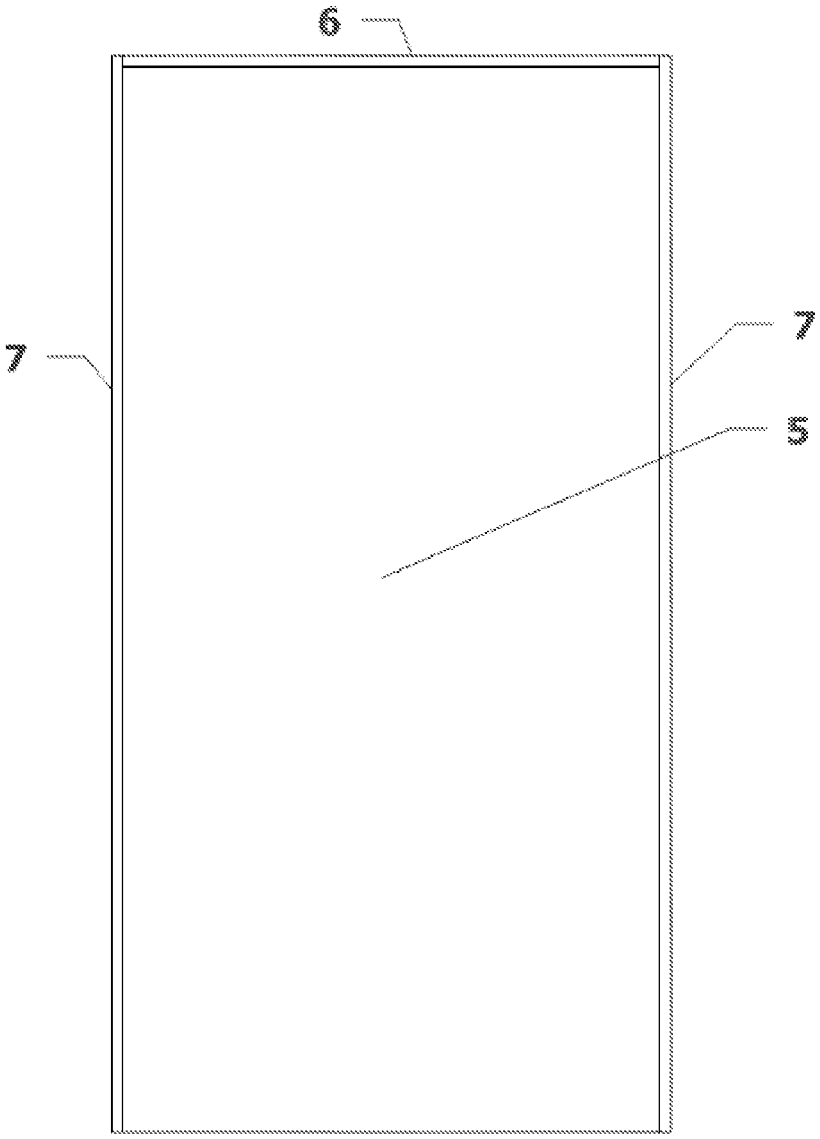

FIG. 16 shows to 'back plate' (5) of both Embodiment 1 and Embodiment 2 of the present invention.

Figure 17:
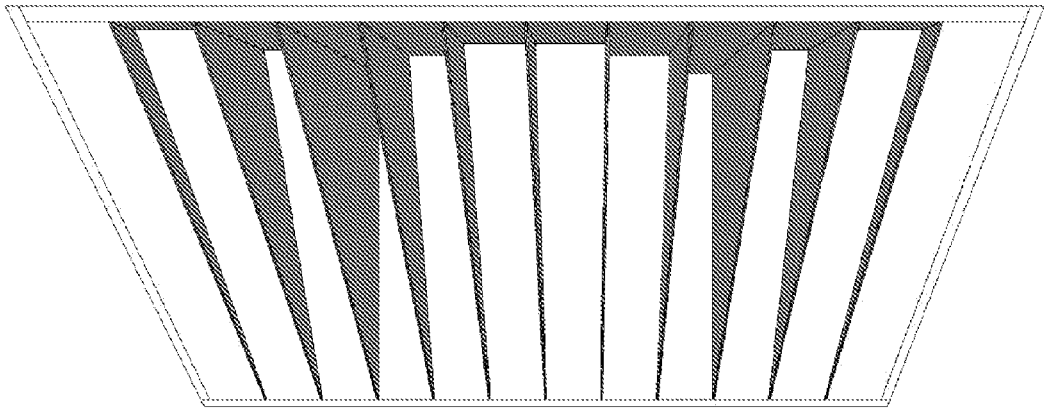

FIG. 17 shows a front-facing isometric view of Embodiment 3 of the present invention. Embodiment 3 uses the following sequence of numbers to determine proportions of well depths using the quadratic residue method: 0, 1, 4, 9, 5, 3, 3, 5, 9, 4, 1, 0. This embodiment uses the length:width: depth proportions of 1:2:1.

Figure 18:
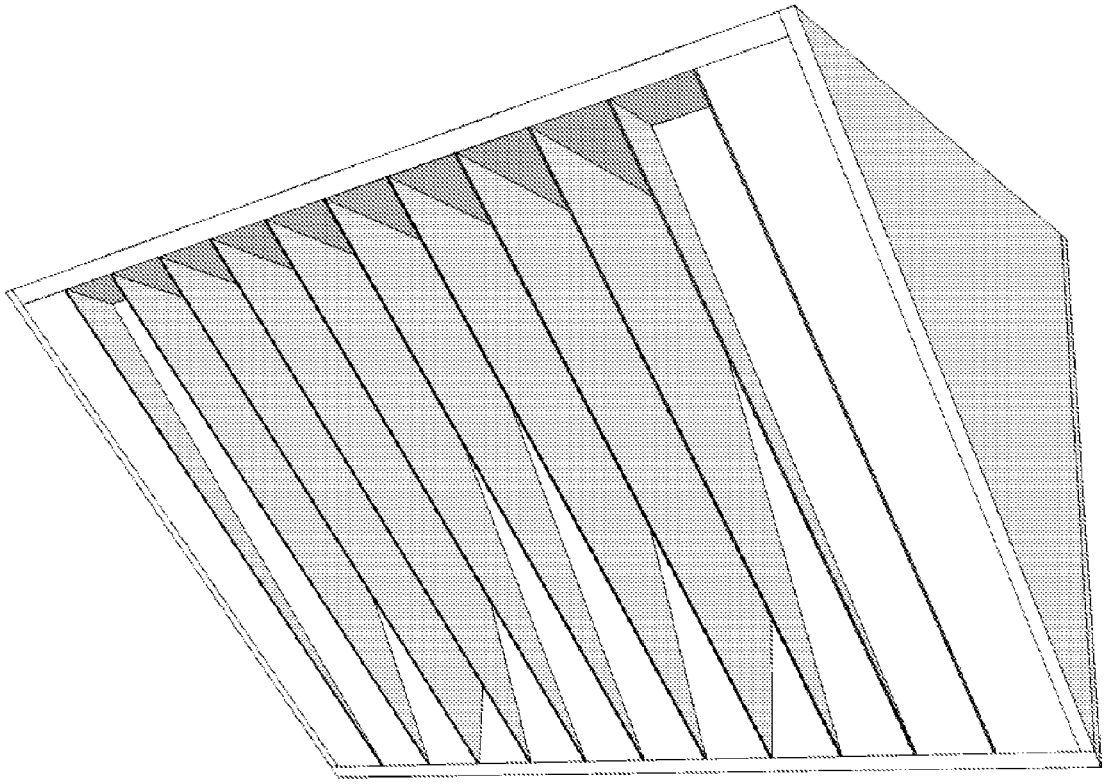

FIG. 18 shows an isometric view of Embodiment 3 of the present invention.

Figure 19:
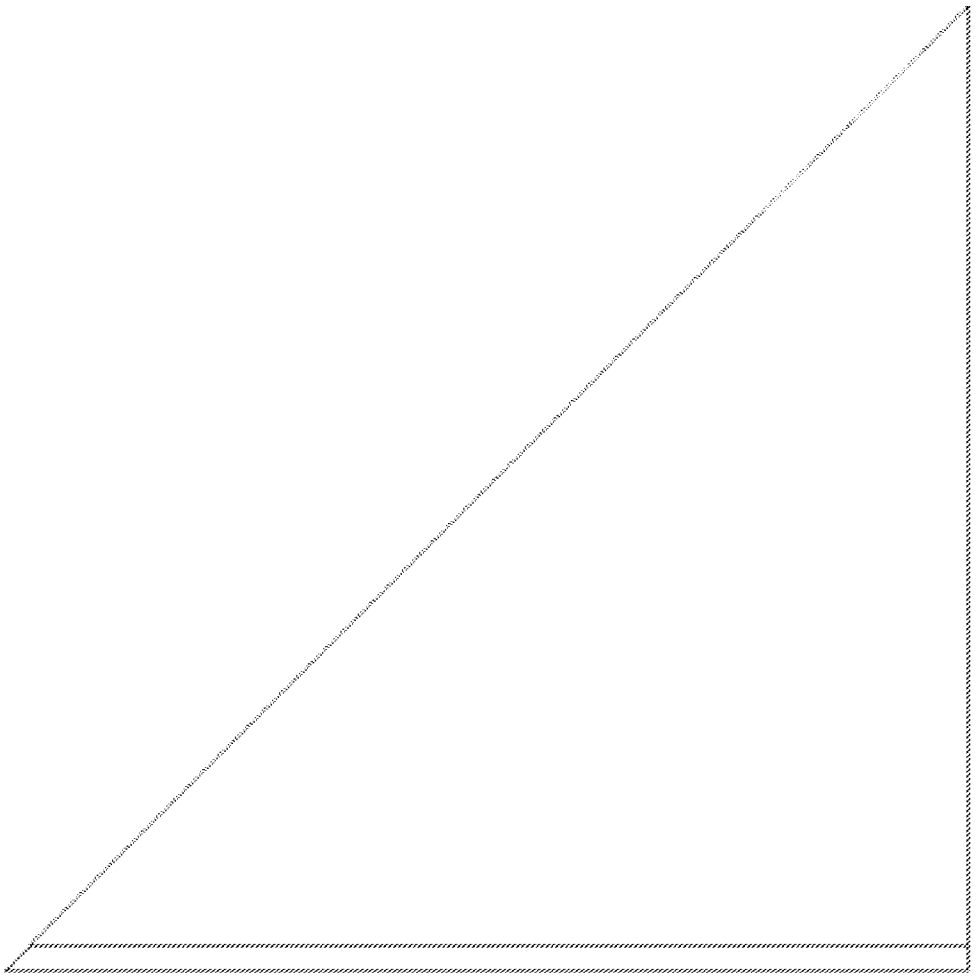

FIG. 19 shows a right side panel of Embodiment 3 of the present invention. The left side panel is the minor image of the right side panel.

Figure 20:
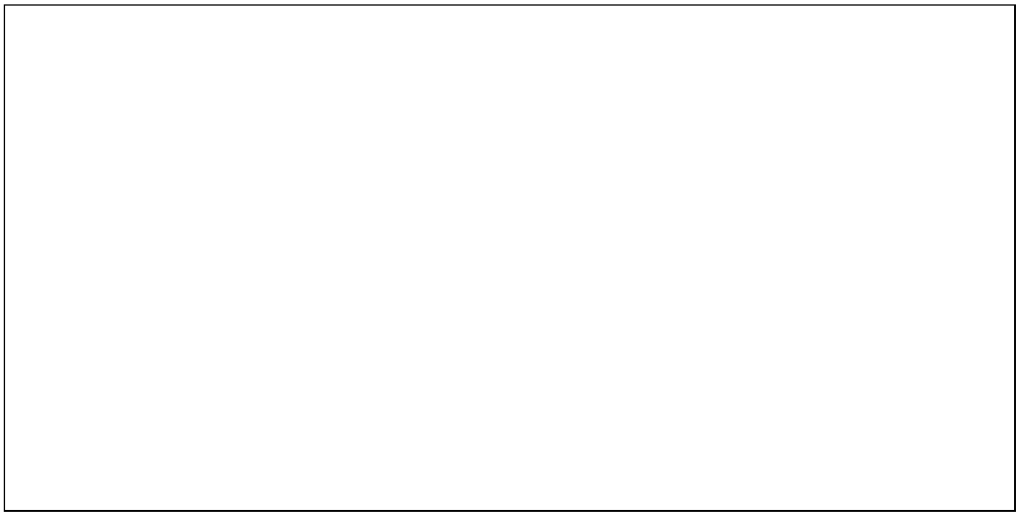

FIG. 20 shows the top view of Embodiment 3 of the present invention. This view is identical to the rear view of Embodiment 3 of the present invention.

Figure 21:
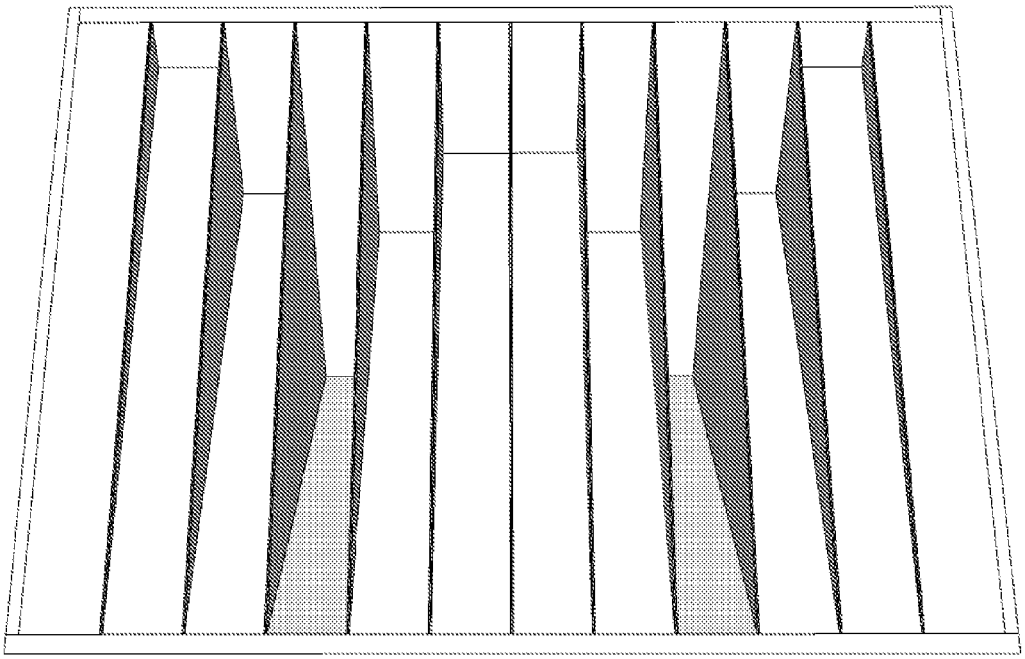

FIG. 21. shows a bottom oblique isometric view of Embodiment 3.

Figure 22:
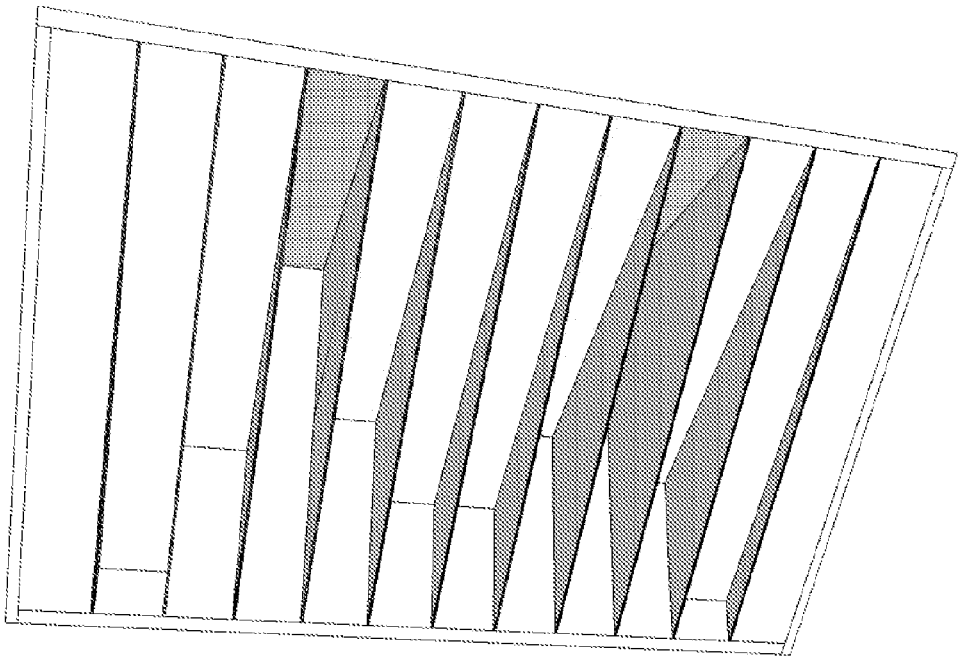

FIG. 22 shows an isometric view of an inverted version of Embodiment 3 of the present invention. This embodiment was created by rotating the embodiment 180 degrees clockwise and then 90 degrees forward.

Figure 23:
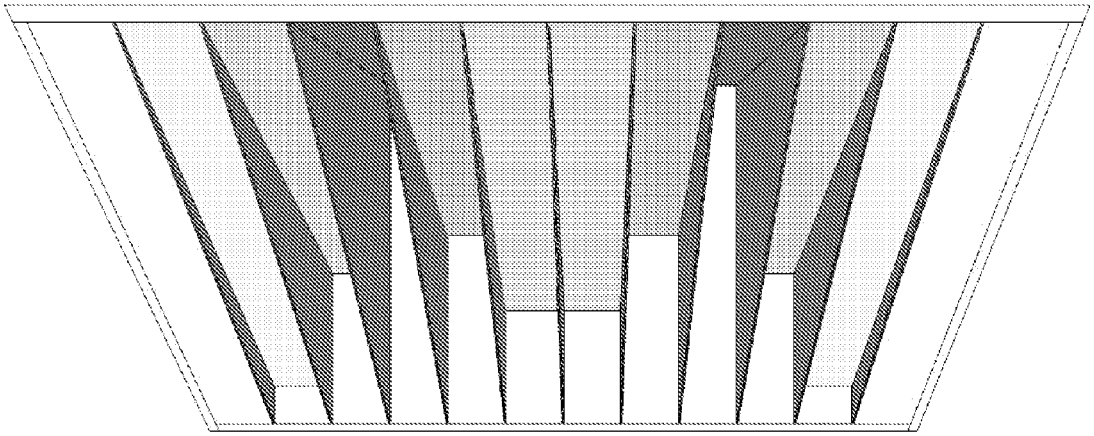

FIG. 23 shows a front oblique isometric view of an inverted version of Embodiment 3 of the present invention.

Figure 24:
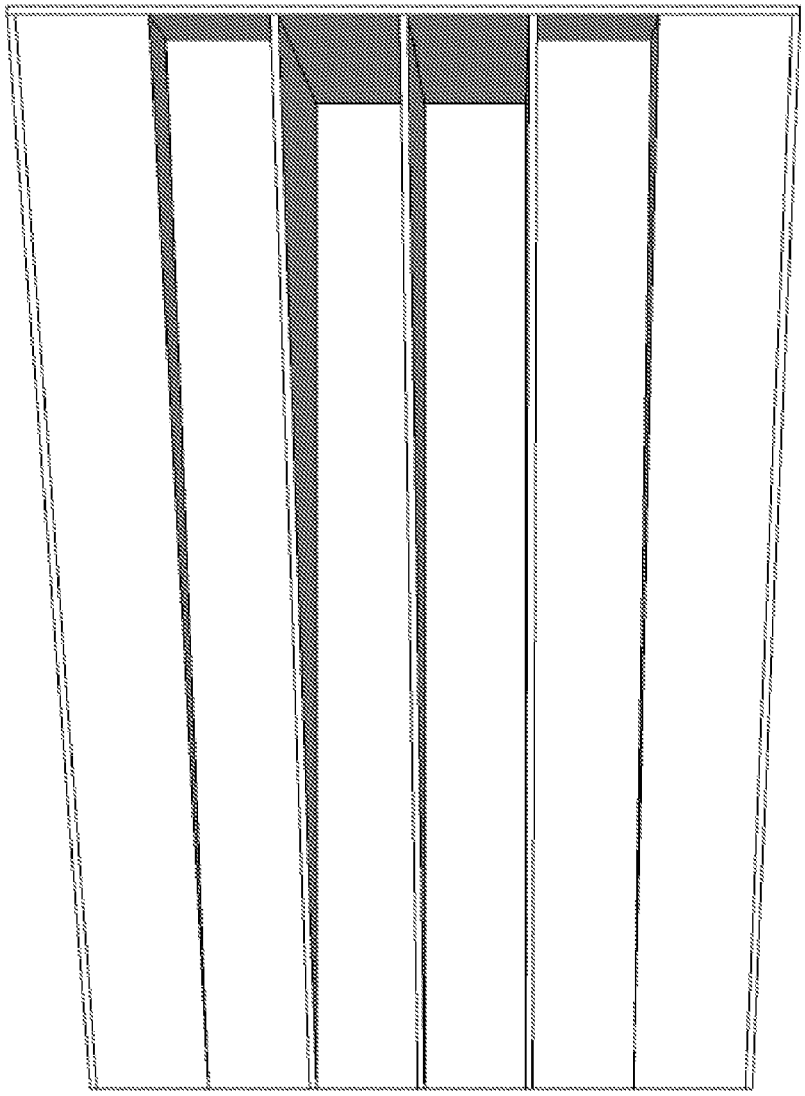

FIG. 24 shows a front facing isometric view of Embodiment 4 of the present invention. Embodiment 4 uses the following number sequence for the depth proportions of the wells: 0, 1, 4, 4, 1, 0. The embodiment uses a ratio of height: width:depth of 3:2:1 to define its dimensions.

Figure 25:
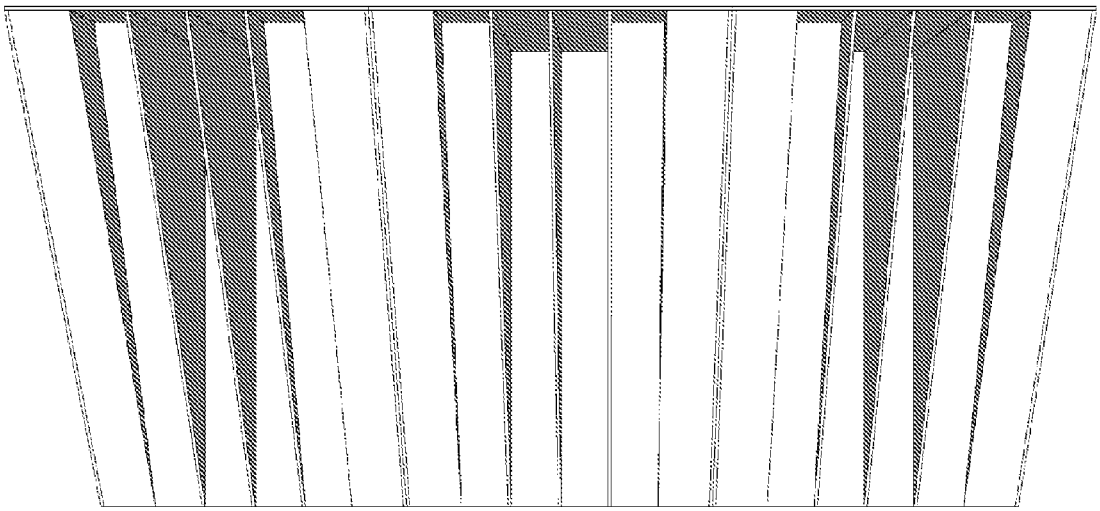

FIG. 25 shows an array of three instances of Embodiment 4 creating a composite with a ratio of height:width:depth or 3:6:1.

Figure 26:
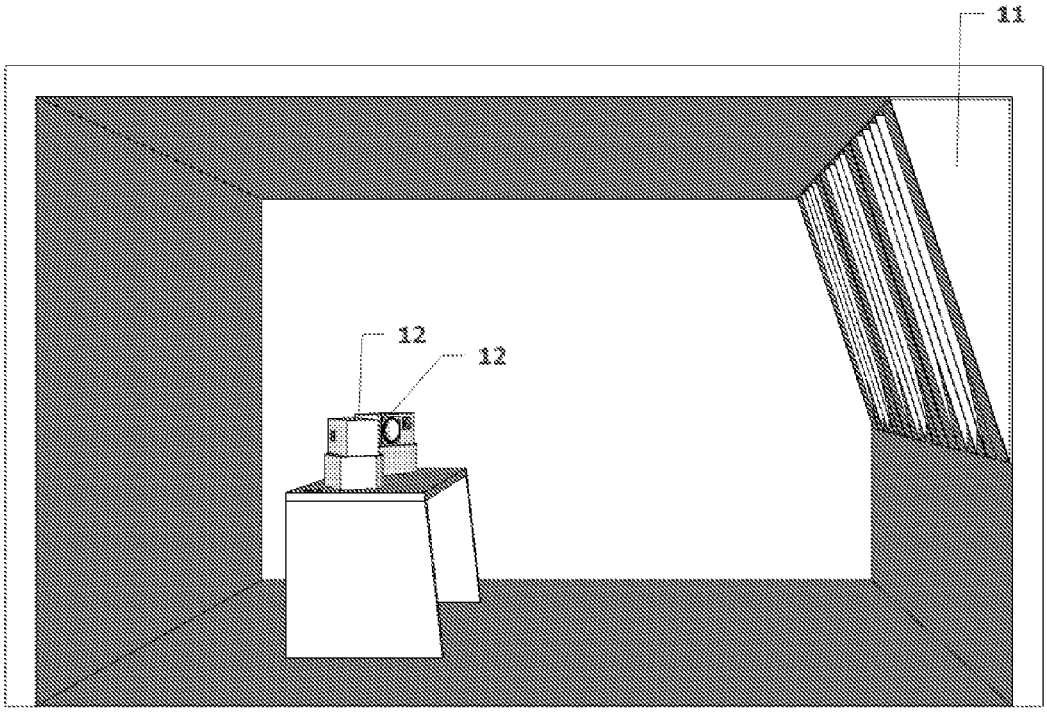

FIG. 26 shows an oblique perspective view of a basic installation of the array shown in FIG. 25 in a room with a critical listening station.

(11) indicates the array of three instances of Embodiment 4.

(12) indicates the two loudspeakers typically used for critical listening in stereo.

Figure 27:
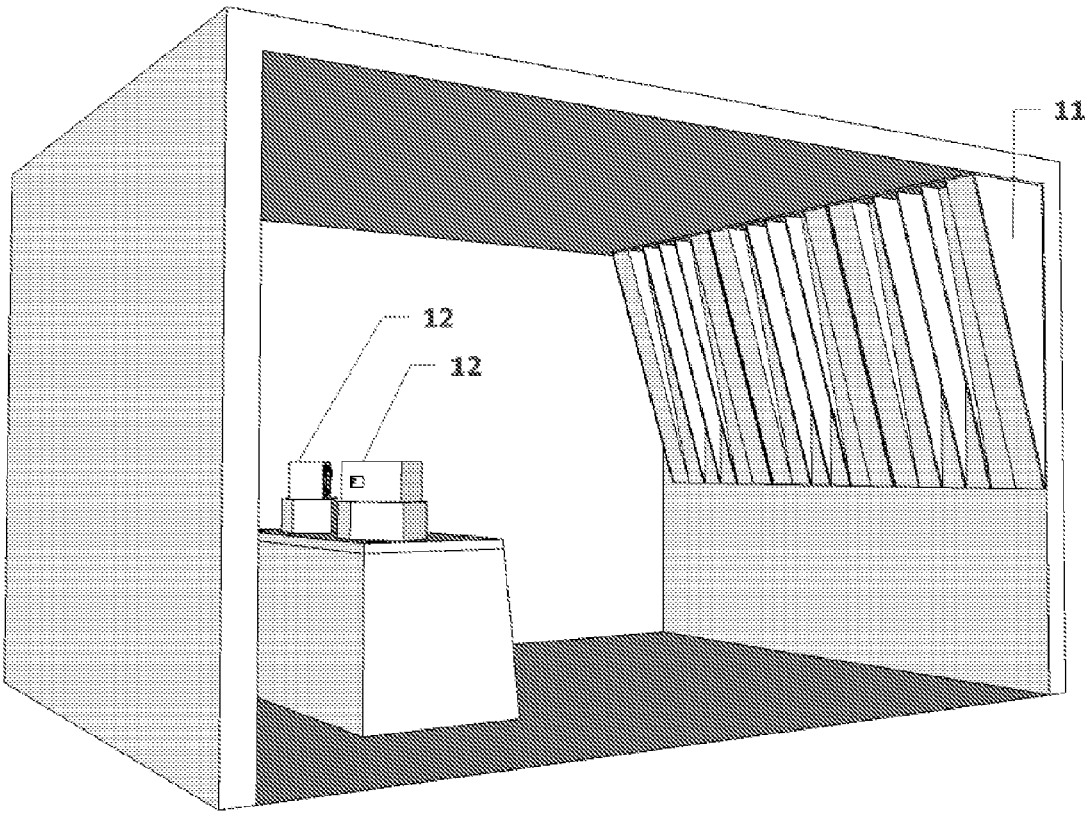

FIG. 27 shows an isometric view of the basic installation shown in FIG. 26.

Figure 28:
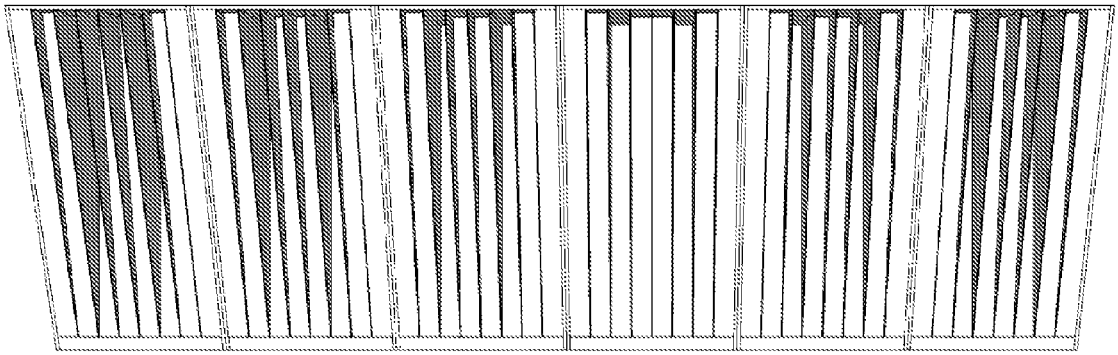

FIG. 28 shows an array made of six instances of Embodiment 1 to be used as a group for installation.

Figure 29:
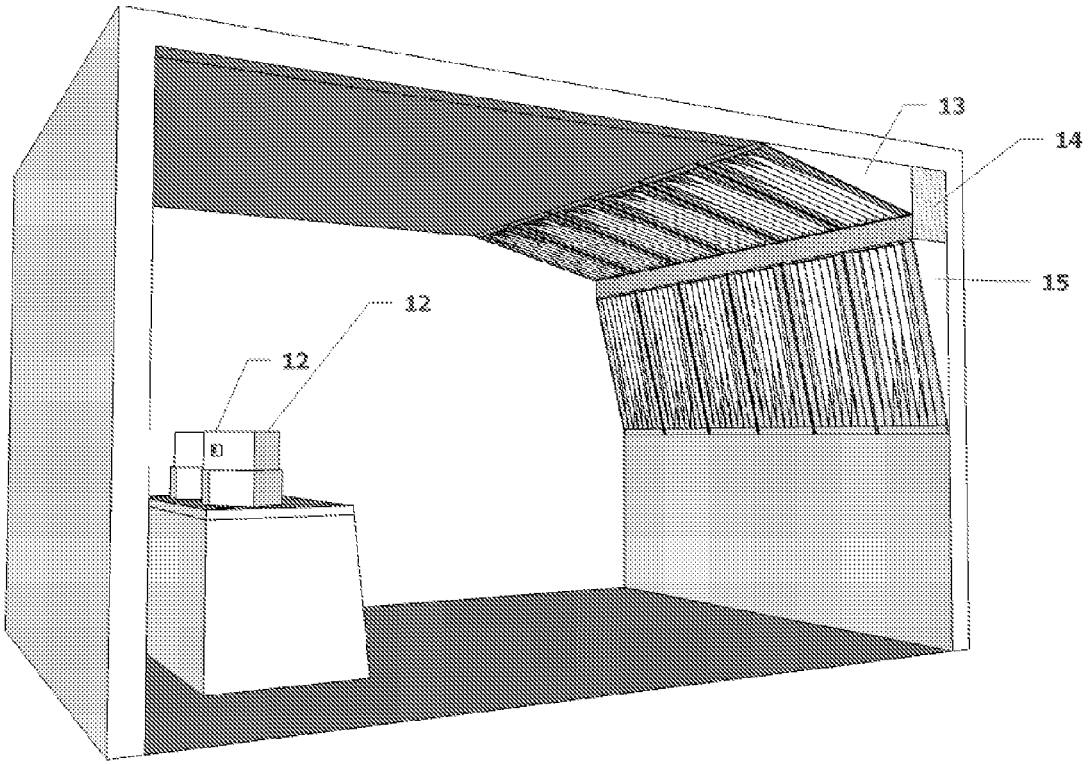

FIG. 29 shows an isometric view of an installation of two of the arrays shown in FIG. 28, with a block of acoustically absorptive material, such as Owens Corning 703 Rigid Fiberglass.

(13) indicates an array of six instances of Embodiment 1 inverted for installation against the ceiling.

(14) indicates a large rectangular mass of acoustically absorptive material, such as Owen Corning 703 Rigid Fiberglass or acoustic foam.

(15) indicates the array shown in FIG. 28.

Figure 30:
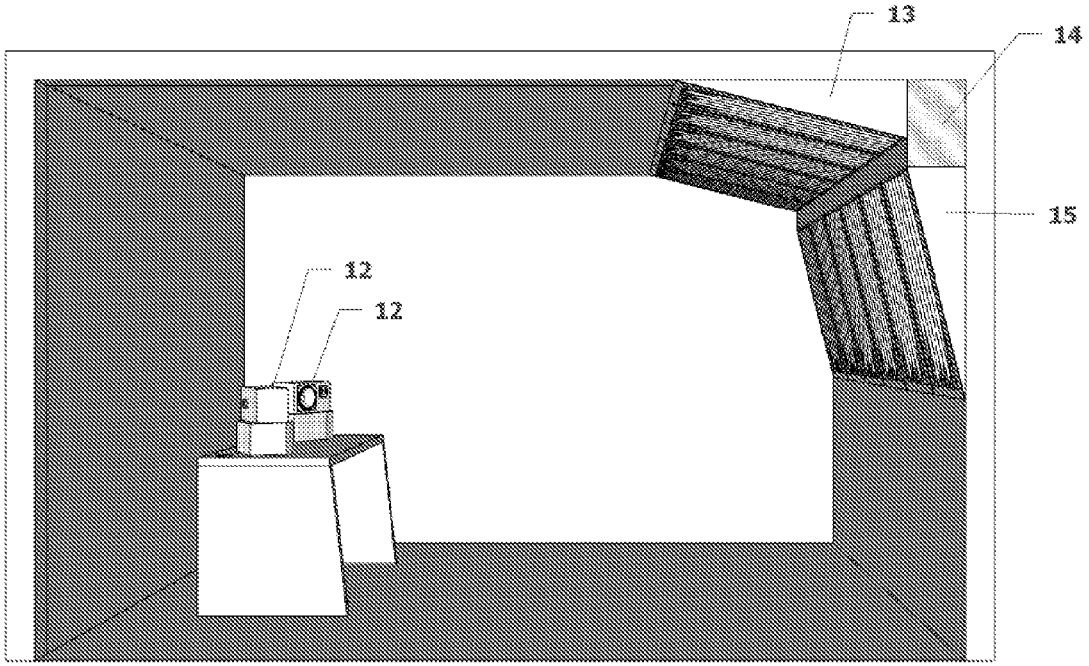

FIG. 30 shows an oblique isometric view of the installation shown in FIG. 29.

Figure 31:
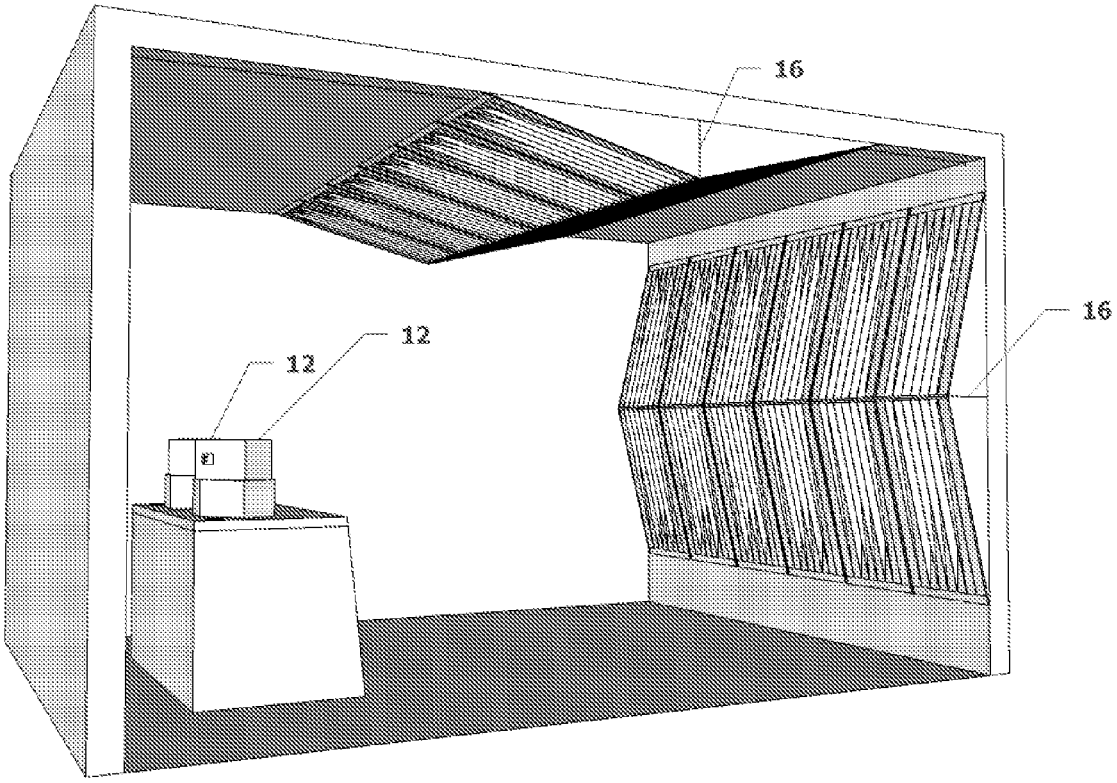
Figure 33:
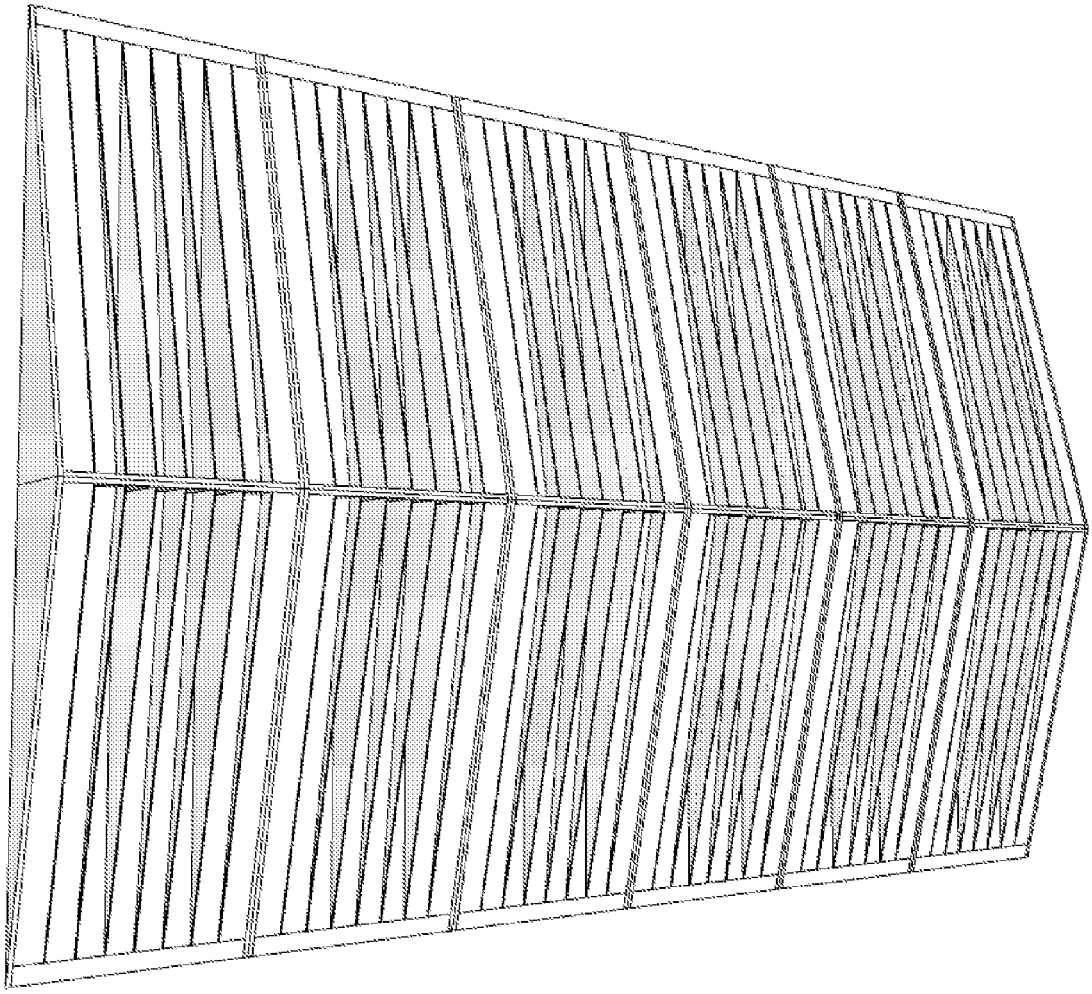
Figure 34:
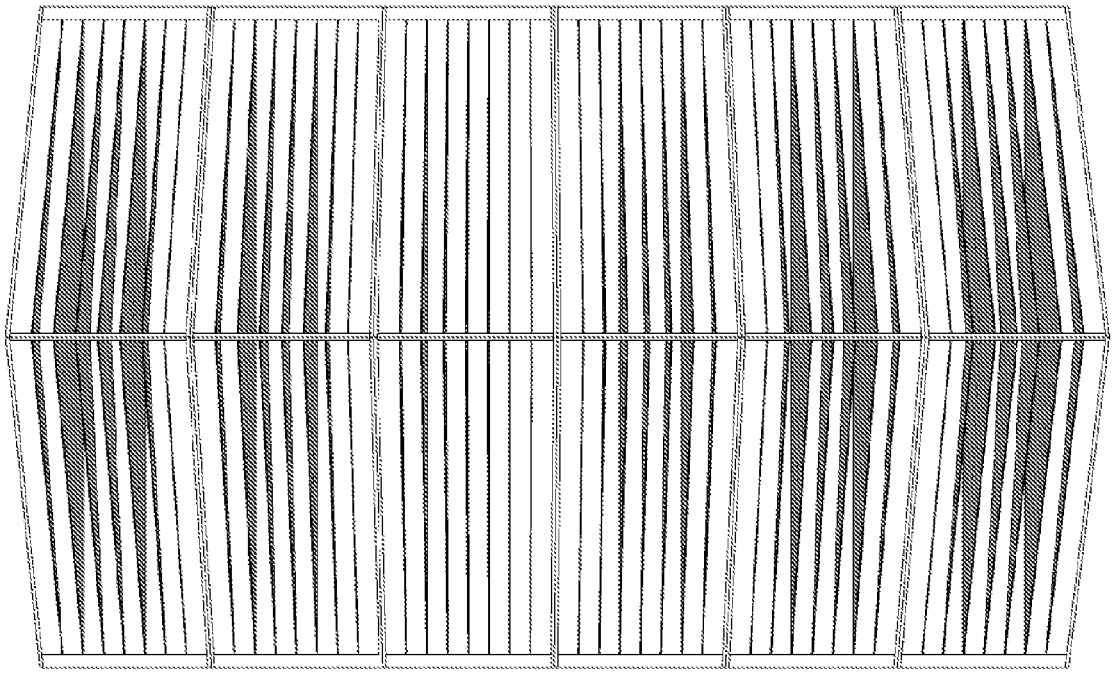

FIG. 31 shows an isometric view of an installation using a pair of arrays shown in FIGS. 33 and FIG. 34. This installation takes advantage of both the reflective and diffusive properties of the present invention. Acoustic energy from the loudspeakers is deflected from the back wall to the ceiling and to the floor. The ceiling further splits the acoustic energy towards the floor and the rear wall.

Figure 32:
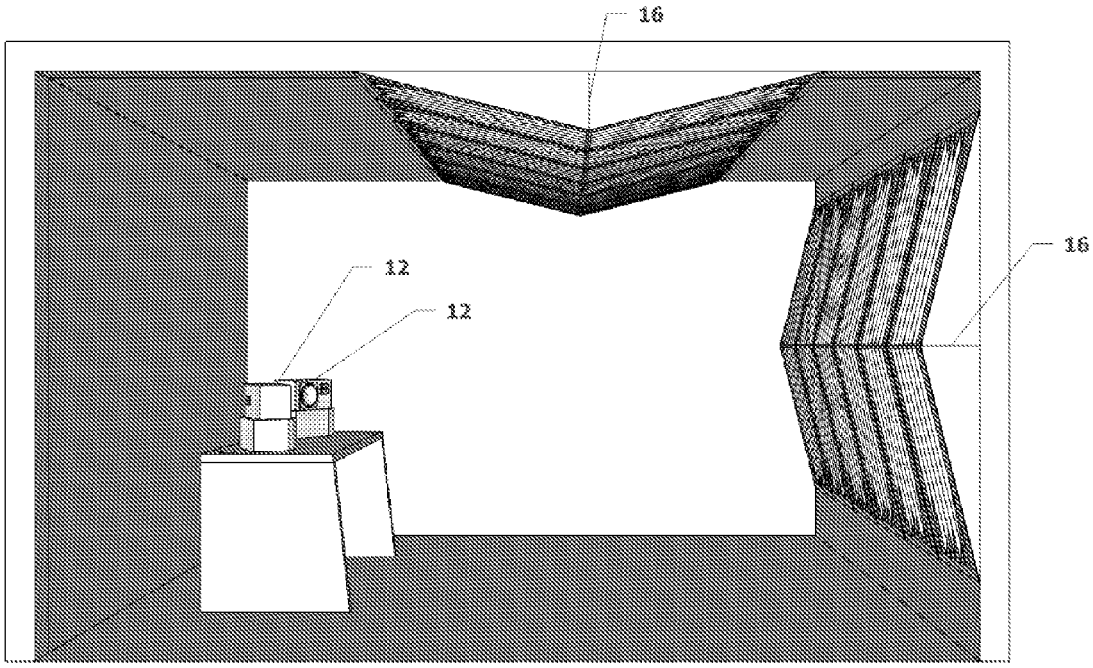

FIG. 32 shows an oblique view of the installation depicted in FIG. 31.

FIG. 33 shows an array of 10 instances Embodiment 1 in a double ramp configuration.

FIG. 34 shows an oblique view of the array depicted in FIG. 33.

DETAILED DESCRIPTION OF THE INVENTION

The Acoustic Ramp may be used in many locations, such as a recording studio control room, a home theater, a classroom, a performance venue, a place of worship or other enclosed or partially enclosed environment where critical listening, sound reproduction or controlled acoustics is required. The Acoustic Ramp could also be used to control acoustics in tunnels or overpasses or other locations where traffic or mechanical noise needs to be mitigated.

Figure 1:
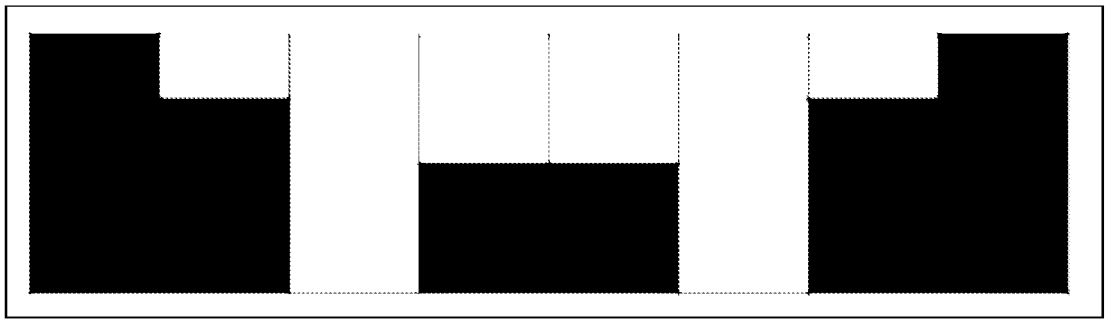
FIG. 1 Prior Art
FIG. 1 shows an elevation of a Quadratic Residue sequence of depths based on prime number 7.
Figure 2:
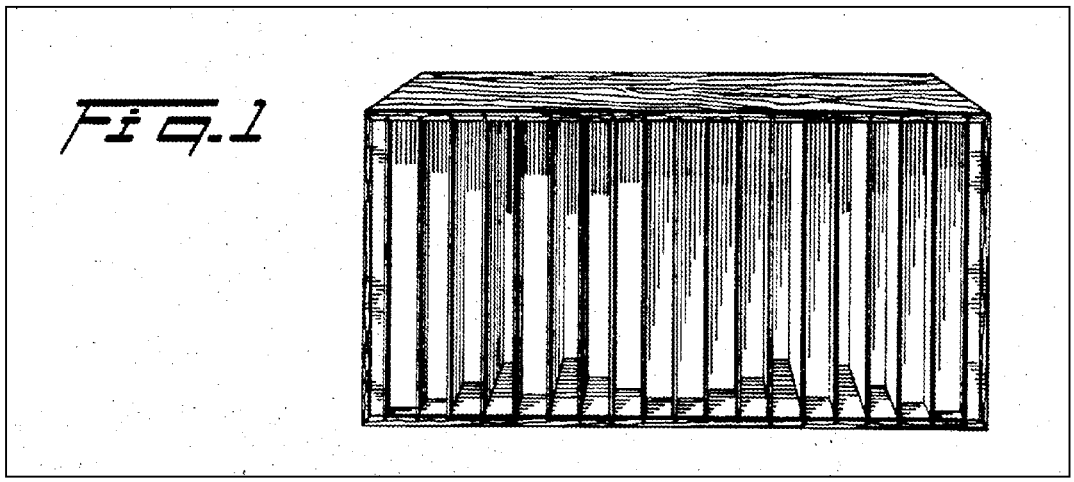
FIG. 2 Prior Art
FIG. 2, FIG. 3, FIG. 4, FIG. 5, and FIG. 6 represent prior art and have been reprinted from the patents.
Figure 3:
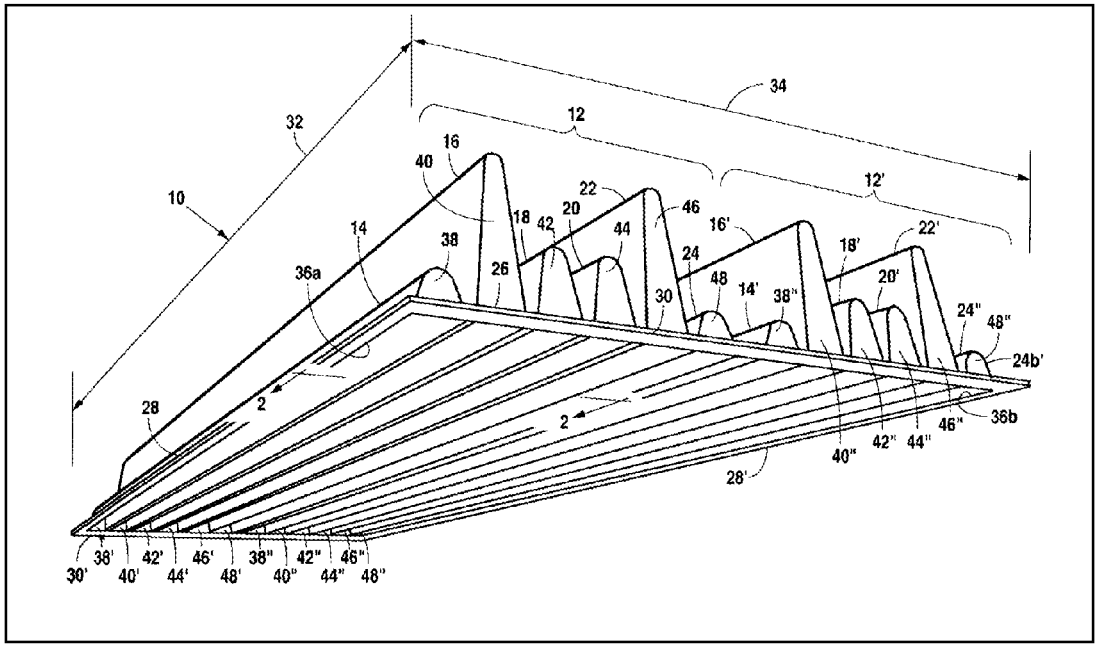
FIG. 3 Prior Art
Figure 4:
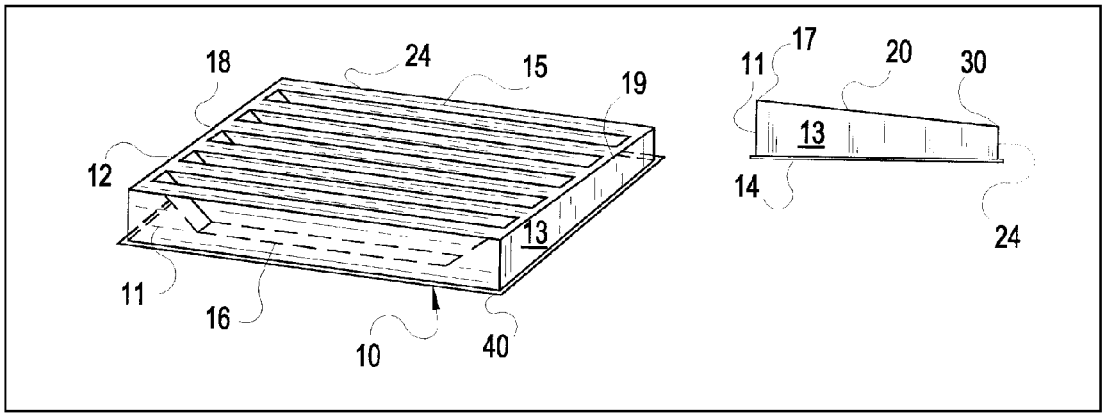
FIG. 4 Prior Art
Figure 5:
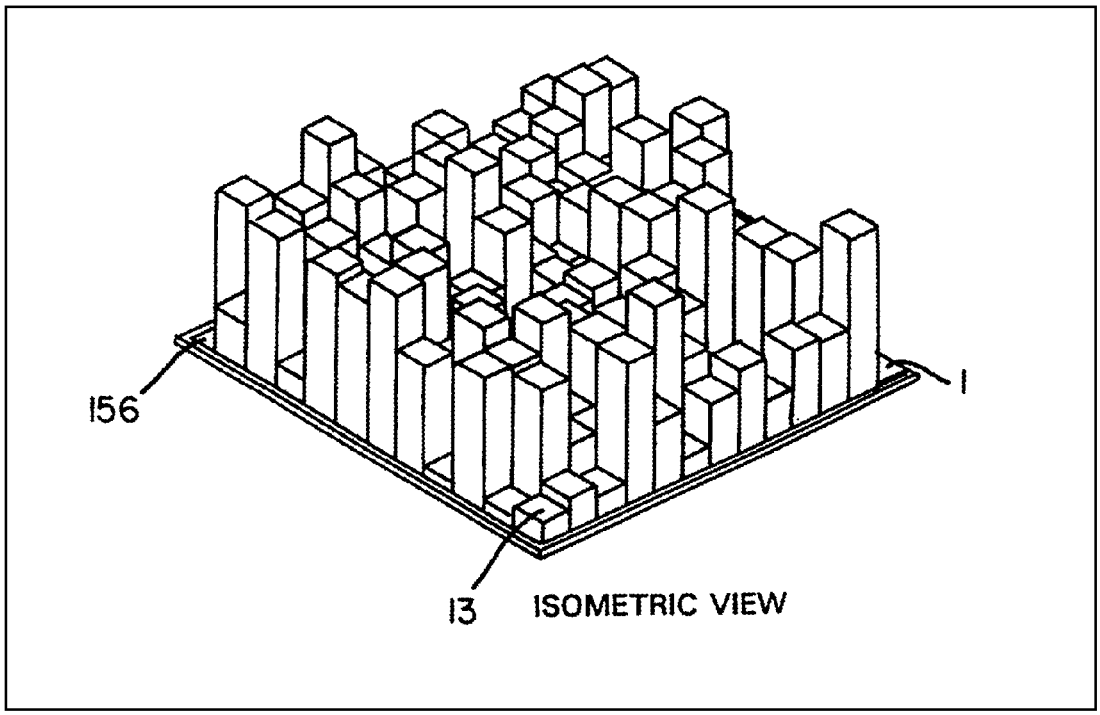
FIG. 5 Prior Art
Figure 6:
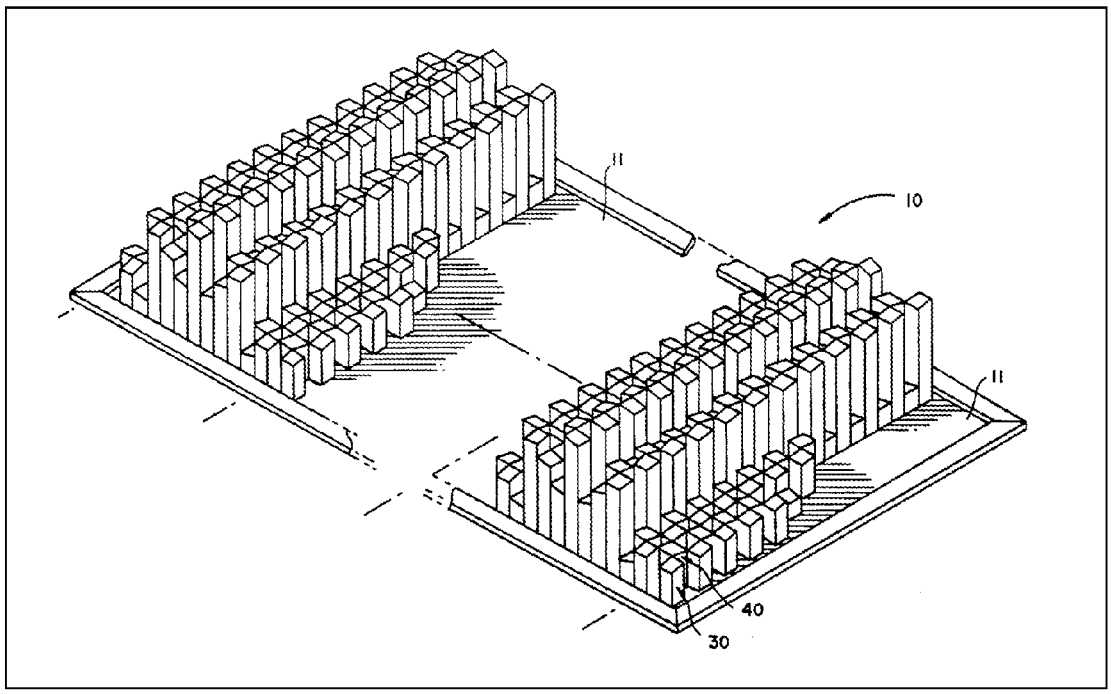
FIG. 6 Prior Art
Figure 7:
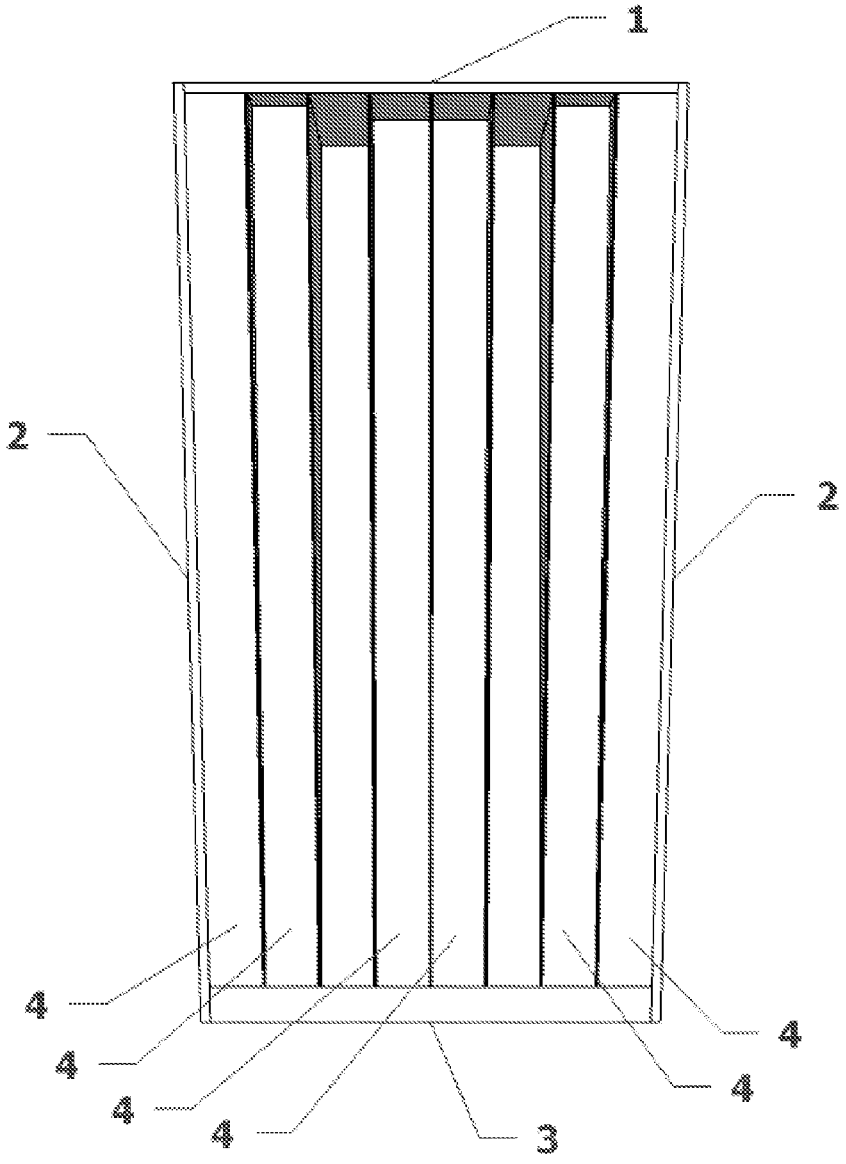
FIG. 7 shows an oblique isometric view of Embodiment 1 of the present invention. This embodiment has a ratio of height:width:depth of 4:2:1. The depth of the 'wells' (See FIG. 10) have the proportions of 0, 1, 4, 2, 2, 4, 1, 0.

The following is a partial list of some of purposes or uses of the present invention. While there are many other possible uses, these are some of the most relevant:

1. To diffuse or scatter reflected acoustic energy
2. To reduce or eliminate the phenomenon commonly referred to as flutter echo, where sounds bounces off of flat walls and creates a distinct echo with a short delay for each wall of a room
3. To reduce reflected acoustic energy without using acoustically absorptive materials that often create what is commonly referred to as dead or non-reflective acoustic response
4. To direct reflected acoustic energy away from the source of the acoustic energy, like a loudspeaker. This use helps to reduce the effect known as comb-filtering in which reflected sound interferes with direct sound and alters the perceived reproduction of an audio signal
5. To reduce the loss of usable floor space needed to obtain the desired result of diffusion
6. To reduce the incidence of standing waves that accumulate between parallel walls in typical rectilinear rooms.
7. To provide an attractive design element in architectural space The Acoustic Ramp is a wedge-shaped acoustic diffuser, possibly constructed by assembling a plurality of triangular flat sheet material of the same approximate size and shape, parallel to each other and separated by the same distance. These triangular pieces shall be known as 'well-dividers (9)', or simply 'dividers'. The shortest legs of the dividers' triangle are connected together with two rectangular pieces of flat material that connect to each other at the vertex, or 'corner (8)' (See FIG. 7, FIG. 8, FIG. 9, and FIG. 10), of the two short legs of the dividers. These pieces shall be referred to as 'plates', with one referred to as the 'top plate (1)' and the other referred to as the 'bottom plate (5),' though the device may be oriented in any direction. The space between each of the dividers shall be called 'wells (6).' The depths of the wells are varied by the addition of planes of reflective surfaces in the wells that connect to the bottom edge (see FIG. 7), but that connect to locations at various distances from the front corner of the top edge. These planes or 'reflectors' form a plurality of angles from both the bottom plate and the top plate. The proportions of the well depths may be determined using a quadratic residue series, a primitive-root series, or other series created with a mathematical algorithm or at random.

In a simple installation (FIG. 26 and FIG. 27), the deepest part of the diffuser is mounted into a corner where a vertical wall meets a horizontal ceiling. The diffuser tapers as it goes down the wall. Thus the room maintains both a spacious feel and retains the full amount of floor real estate. The thickest part of the diffuser is located in the upper corner which is the least-used space of the room. This allows for the deepest parts of the wells in the diffuser to diffuse lower frequencies. The tapering of the diffuser allows for a wide range of frequencies to be diffused.

The Acoustic Ramp may be installed as part of an array to form larger and more complex diffuser structures. The ramp array structures may be constructed by joining the top plates of two or more embodiments of the invention or the side panels of two or more embodiments of the invention. The installation of these arrays may take many forms. Some likely installations are those depicted in FIG. 25 through FIG. 34 which show both several different types of arrays and different styles of installation. The arrays that are configured by attaching the top plates of two arrays together are known as 'double-ramp' arrays and are used to split acoustic energy by reflecting it into two different directions in addition to scattering the energy in one dimension in a semi-circular pattern. Although it would void the space saving benefits, the Acoustic Ramp may be installed in the corners where a wall meets a wall or where a wall meets the floor. These installations would be to fulfill a very specific acoustic need and would be unlikely commonplace.

Although several embodiments of said invention have been described and shown in drawings, it is likely that changes and modifications may be made to the invention. These changes may be made without departing from the spirit of the commonalities of the embodiments shown herein. The intent of the claims defined below is to define the scope and breadth of the invention.

After describing the invention above, what is claimed is:

1. An acoustic diffuser comprising;

a first triangular-prism-shaped outer box with a largest rectangular face at least partially open; and a first array of contiguous triangular-prism-shaped wells with irregular volumes;

wherein the first array of contiguous triangular-prism-shaped wells are separated by a first plurality of dividers each having a first shape; the first plurality of dividers are positioned in first planes that are parallel to a first triangular base of the first triangular-prism-shaped outer box; the first array of contiguous triangular-prism-shaped wells are defined by a first plurality of inclined planes beginning at a first most acute vertex of the first triangular-prism-shaped outer box; the first plurality of inclined planes each rise to a varying height determined by a first predetermined number sequence; the first plurality of inclined planes each rise at an angle between 0 and 45 degrees; the first array of contiguous triangular-prism-shaped wells may be enclosed on at least one side by a first additional sheet material; the first additional sheet material has a second shape which is the same as the first shape; and the first triangular-prism-shaped outer box has a first side that is enclosed by a first rectangular piece of material that joins the tallest edges of the first plurality of dividers.

2. The acoustic diffuser of claim 1 further comprising:

a second triangular-prism-shaped outer box with a largest rectangular face at least partially open; and a second array of contiguous triangular-prism-shaped wells with irregular volumes;

wherein the second array of contiguous triangular-prism-shaped wells are separated by a second plurality of dividers each having a third shape; the second plurality of dividers are positioned in second planes that are parallel to a second triangular base of the second triangular-prism-shaped outer box; the second array of contiguous triangular-prism-shaped wells are defined by a second plurality of inclined planes beginning at a second most acute vertex of the second triangular-prism-shaped outer box; the second plurality of inclined planes each rise to a varying height determined by a second predetermined number sequence; the second plurality of inclined planes each rise at an angle between 0 and 45 degrees; the second array of contiguous triangular-prism-shaped wells may be enclosed on at least one side by a second additional sheet material; the second additional sheet material has a fourth shape which is the same as the third shape; the second triangular-prism-shaped outer box has a second side that is enclosed by a second rectangular piece of material that joins the tallest edges of the second plurality of dividers; and a surface of the first triangular-prism-shaped outer box is skewed with respect to an opposing surface of the second triangular-prism-shaped outer box.

3. The acoustic diffuser of claim 1 wherein the first triangular-prism-shaped outer box is positioned to direct an acoustic energy away a source of the acoustic energy.

4. The acoustic diffuser of claim 1 wherein the first triangular-prism-shaped outer box is positioned in an upper corner of a room where a wall surface meets a ceiling surface.

5. The acoustic diffuser of claim 1 wherein the first triangular-prism-shaped outer box is positioned in a corner of a room where a first wall surface meets a second wall surface.

6. The acoustic diffuser of claim 1 wherein the first triangular-prism-shaped outer box is positioned a corner of a room where a first wall surface meets a floor surface.

* * * * *